US006215469B1

(12) United States Patent
Mori et al.

(10) Patent No.: US 6,215,469 B1
(45) Date of Patent: Apr. 10, 2001

(54) IMAGE DISPLAY METHOD

(75) Inventors: Mitsuhiro Mori, Ibaraki; Jumpei Hashiguchi, Neyagawa; Mitsuhiro Kasahara, Hirakata; Shizuo Inohara, Toyonaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/104,110

(22) Filed: Jun. 25, 1998

(30) Foreign Application Priority Data

Jun. 25, 1997 (JP) ..... 9-168250
Oct. 29, 1997 (JP) ..... 9-296738
Apr. 17, 1998 (JP) ..... 10-107573

(51) Int. Cl.[7] ..... G09G 5/10
(52) U.S. Cl. ..... 345/148; 345/60; 345/63
(58) Field of Search ..... 345/60, 61, 62, 345/63, 64, 65, 66, 67, 68, 147, 148; 315/169.1, 169.4

(56) References Cited

U.S. PATENT DOCUMENTS 5,684,499 * 11/1997 Shimizu et al. ..... 345/60
5,835,072 * 11/1998 Kanazawa ..... 345/60
6,018,329 * 1/2000 Kida et al. ..... 345/60
6,037,971 * 3/2000 Kawakami ..... 345/63

FOREIGN PATENT DOCUMENTS 306 011 A2 3/1989 (EP) .
0 833 299 4/1998 (EP) .
2 740 253 4/1997 (FR) .
2 740 598 4/1997 (FR) .
4-195087 7/1992 (JP) .
WO 94/09473 4/1994 (WO) .

OTHER PUBLICATIONS

European Search Report for International Application No. EP 98 11 1713 dated Nov. 2, 1998.

T. Masuda et al., "New Category Contour Noise Observed in Pulse–Width–Modulated Moving Images", Dept. of Electronic Engineering, University of Electro–Communications, ITEJ Technical Report, vol. 19, No. 2, Jan. 19, 1995, pp. 61–66.

* cited by examiner

*Primary Examiner*—Xiao Wu
(74) *Attorney, Agent, or Firm*—Ratner & Prestia

(57) ABSTRACT

Luminous gradations are displayed to display luminous half tones. This is accomplished by superposing in time wise fashion a plurality of binary images, in which the binary images are individually assigned with a weight according to respective luminous level so that an absolute value of difference ("primary difference") of the weights that are assigned to each of the adjoining binary images becomes equal to or less than 6% of a total number of luminous gradations that are displayed by superposing the binary images, when the binary images are arranged in an ascending order.

38 Claims, 31 Drawing Sheets

| Sub-field number | 1 | 2 | 3 | 4 | 5 | 6 | 7 | 8 | 9 | 10 | 11 | 12 |
|---|---|---|---|---|---|---|---|---|---|---|---|---|
| Weight(luminous level) | 1 | 2 | 4 | 8 | 9 | 10 | 11 | 21 | 38 | 49 | 50 | 52 |
| Primary difference | 1 | 2 | 4 | 1 | 1 | 1 | 10 | 17 | 11 | 1 | 2 | |

FIG. 5

| Sub-field number | 1 | 2 | 3 | 4 | 5 | 6 | 7 | 8 | 9 | 10 | 11 | 12 |
|---|---|---|---|---|---|---|---|---|---|---|---|---|
| Weight(luminous level) | 1 | 2 | 4 | 7 | 11 | 16 | 21 | 26 | 32 | 38 | 45 | 52 |
| Primary difference | | 1 | 2 | 3 | 4 | 5 | 5 | 5 | 6 | 6 | 7 | 7 |
| Secondary difference | | | 1 | 1 | 1 | 1 | 0 | 0 | 1 | 0 | 1 | 0 |

FIG. 15

| Sub-field number | 1 | 2 | 3 | 4 | 5 | 6 | 7 | 8 | 9 | 10 | 11 | 12 |
|---|---|---|---|---|---|---|---|---|---|---|---|---|
| Luminous level | 1 | 2 | 4 | 7 | 11 | 16 | 20 | 25 | 31 | 38 | 46 | 54 |

| Luminous level | | | | | | |
|---|---|---|---|---|---|---|
| 1 | O | | | | | |
| 2 | | O | | | | |
| 3 | O | O | | | | |
| 4 | | | O | | | |
| 5 | O | | O | | | |
| 6 | | O | O | | | |
| 7 | O | O | O | | | |
| 8 | O | | | O | | |
| 9 | | O | | O | | |
| 10 | O | O | | O | | |
| 11 | | | O | O | | |
| 12 | O | | O | O | | |
| 13 | | O | O | O | | |
| 14 | O | O | O | O | | |
| 15 | | | O | | O | |
| 16 | O | | O | | O | |
| 17 | | O | O | | O | |
| 18 | O | O | O | | O | |
| 19 | O | | | O | O | |
| 20 | | O | | O | O | |
| 21 | O | O | | O | O | |
| 22 | | | O | O | O | |
| 23 | O | | O | O | O | |
| 24 | | O | O | O | O | |
| 25 | O | O | O | O | O | |
| 26 | O | O | | O | | O |
| 27 | | | O | O | | O |
| 28 | O | | O | O | | O |
| 29 | | O | O | O | | O |
| 30 | O | O | O | O | | O |

O indicates sub-field to be illuminated

FIG. 17

| Sub-field number | 1 | 2 | 3 | 4 | 5 | 6 | 7 | 8 | 9 | 10 | 11 | 12 |
|---|---|---|---|---|---|---|---|---|---|---|---|---|
| Luminous level | 1 | 2 | 4 | 7 | 11 | 16 | 20 | 25 | 31 | 38 | 46 | 54 |
| Luminous level | | | | | | | | | | | | |
| 1 | O | | | | | | | | | | | |
| 2 | | O | | | | | | | | | | |
| 3 | O | O | | | | | | | | | | |
| 4 | | | O | | | | | | | | | |
| 5 | O | | O | | | | | | | | | |
| 6 | | O | O | | | | | | | | | |
| 7 | | | | O | | | | | | | | |
| 8 | O | | | O | | | | | | | | |
| 9 | | O | | O | | | | | | | | |
| 10 | O | O | | O | | | | | | | | |
| 11 | | | | | O | | | | | | | |
| 12 | O | | | | O | | | | | | | |
| 13 | | O | | | O | | | | | | | |
| 14 | O | O | | | O | | | | | | | |
| 15 | | | O | | O | | | | | | | |
| 16 | | | | | | O | | | | | | |
| 17 | O | | | | | O | | | | | | |
| 18 | | O | | | | O | | | | | | |
| 19 | O | O | | | | O | | | | | | |
| 20 | | | | | | | O | | | | | |
| 21 | O | | | | | | O | | | | | |
| 22 | | O | | | | | O | | | | | |
| 23 | O | O | | | | | O | | | | | |
| 24 | | | O | | | | O | | | | | |
| 25 | | | | | | | | O | | | | |
| 26 | O | | | | | | | O | | | | |
| 27 | | O | | | | | | O | | | | |
| 28 | O | O | | | | | | O | | | | |
| 29 | | | O | | | | | O | | | | |
| 30 | O | | O | | | | | O | | | | |

O indicates sub-field to be illuminated

FIG. 18

| Sub-field number | 1 | 2 | 3 | 4 | 5 | 6 | 7 | 8 | 9 | 10 | 11 | 12 |
|---|---|---|---|---|---|---|---|---|---|---|---|---|
| Weight(luminous level) | 1 | 2 | 4 | 6 | 10 | 14 | 19 | 26 | 33 | 40 | 47 | 53 |
| Primary difference | | 1 | 2 | 2 | 4 | 4 | 5 | 7 | 7 | 7 | 7 | 6 |
| Secondary difference | | | 1 | 0 | 2 | 0 | 1 | 2 | 0 | 0 | 0 | -1 |

FIG. 24

| Sub-field number | 1 | 2 | 3 | 4 | 5 | 6 | 7 | 8 | 9 | 10 | 11 |
|---|---|---|---|---|---|---|---|---|---|---|---|
| Weight(luminous level) | 1 | 2 | 4 | 8 | 13 | 19 | 26 | 34 | 42 | 49 | 57 |
| Primary difference | | 1 | 2 | 4 | 5 | 6 | 7 | 8 | 8 | 7 | 8 |
| Secondary difference | | | 1 | 2 | 1 | 1 | 1 | 1 | 0 | -1 | 1 |

FIG. 25

| Sub-field number | 1 | 2 | 3 | 4 | 5 | 6 | 7 | 8 | 9 | 10 | 11 |
|---|---|---|---|---|---|---|---|---|---|---|---|
| Weight(luminous level) | 1 | 2 | 4 | 8 | 14 | 20 | 26 | 33 | 41 | 49 | 57 |
| Primary difference | | 1 | 2 | 4 | 6 | 6 | 6 | 7 | 8 | 8 | 8 |
| Secondary difference | | | 1 | 2 | 2 | 0 | 0 | 1 | 1 | 0 | 0 |

FIG. 26

| Sub-field number | 1 | 2 | 3 | 4 | 5 | 6 | 7 | 8 | 9 | 10 |
|---|---|---|---|---|---|---|---|---|---|---|
| Weight(luminous level) | 1 | 2 | 4 | 8 | 16 | 25 | 34 | 44 | 55 | 66 |
| Primary difference | 1 | 2 | 4 | 8 | 9 | 9 | 10 | 11 | 11 | |
| Secondary difference | 1 | 2 | 4 | 1 | 0 | 1 | 1 | 0 | | |

FIG. 27

| Sub-field number | 1 | 2 | 3 | 4 | 5 | 6 | 7 | 8 | 9 | 10 |
|---|---|---|---|---|---|---|---|---|---|---|
| Weight(luminous level) | 1 | 2 | 4 | 8 | 15 | 24 | 33 | 44 | 56 | 68 |
| Primary difference | | 1 | 2 | 4 | 7 | 9 | 9 | 11 | 12 | 12 |
| Secondary difference | | | 1 | 2 | 3 | 2 | 0 | 2 | 1 | 0 |

FIG. 28

| Luminous gradation \ Sub-field | 1 | 2 | 3 | 4 | 5 | 6 | 7 | 8 |
|---|---|---|---|---|---|---|---|---|
| Weight | 1 | 2 | 4 | 8 | 16 | 32 | 64 | 128 |
| 0 | | | | | | | | |
| 1 | ON | | | | | | | |
| 2 | | ON | | | | | | |
| 3 | ON | ON | | | | | | |
| 4 | | | ON | | | | | |
| 5 | ON | | ON | | | | | |
| 6 | | ON | ON | | | | | |
| 7 | ON | ON | ON | | | | | |
| 8~15 | (same as 0~7) | | | ON | | | | |
| 16~31 | (same as 0~15) | | | | ON | | | |
| 32~63 | (same as 0~32) | | | | | ON | | |
| 64~127 | (same as 0~64) | | | | | | ON | |
| 128~255 | (same as 0~128) | | | | | | | ON |

Sub-fields marked by "ON" illuminate for each gradation

IMAGE DISPLAY METHOD

FIELD OF THE INVENTION

The present invention relates to a method for displaying luminous half tones by superposing in time wise a plurality of sub-fields of binary image which are individually given with a weight according to respective luminous level, as it is called a half tones displaying method for display devices using a sub-field method, in luminous gradation displaying devices having a binary memory such as plasma display panels (hereinafter called "PDP") or a digital micromirror devices.

BACKGROUND OF THE INVENTION

The so called sub-field method of the prior art, as described in Japanese Patent Laid-Open Publication No. H04-195087, is used in display devices having a binary memory effect (such as PDP) for displaying luminous half tones. FIGS. 30A and 30B show an example of this method. The image display device writes down control data for turning luminescence on and off in advance for all picture elements of a display screen, and then illuminates all the picture elements at once according to the control data. This method enables the image display device to display television pictures having 256 gradations of luminous tone of eight bit coding. An example of this method is described below.

An example of the prior art in which one field of image is constituted by eight sub-fields of binary image, as shown in FIG. 30A, is now described. Each of the sub-fields has a luminant period (a period in which any sub-fields illuminate during an ON state) and a nonluminant period, and shaded portions are the luminant periods. A time length of the luminant period or a number of pulses illuminated during the ruminant period corresponds to the weight given according to the luminous level, although the nonluminant periods are nearly equal throughout every sub-field. Each sub-field is assigned with a sub-field number, and a different weight is given on each sub-field having a sub-field number.

The sub-field method obtains luminous gradations by varying the time length of luminous level or the number of luminant pulses within a time period which is a period for one field (a lapse of time) in which an afterimage of human vision is available. Humans perceive a luminous level of each picture element as an integrated sum of the illuminated time or as a cumulative number of luminant pulses with respect to individual picture elements in each sub-field of one field.

In the example of FIGS. 30A and 30B, each sub-field is given with a weight (hereinafter called "luminous level") corresponding to the luminous level of 1, 2, 4, 8, 16, 32, 64 and 128 respectively according to the binary notation. For example, a sub-field having a sub-field number of "1" (hereinafter called "sub-field 1") illuminates once in order to produce a luminous level of "1", and a sub-field of "sub-field 8" illuminates 128 times in order to produce a luminous level of "128".

FIG. 30B shows the sub-fields to be illuminated so as to display the required luminous gradations. The sub-fields and a weight given to each of the sub-field numbers are shown on the abscissa, and the luminous gradations to be displayed are shown on the ordinate. Sections that are marked with "ON" in the diagram indicate the sub-fields to be illuminated for displaying the luminous gradations on the ordinate.

More specifically, the sub-field 1 is illuminated for displaying the luminous gradation 1. Likewise, it illustrates the sub-field 2 for displaying the luminous gradation 2, the sub-fields 1 and 2 for displaying the luminous gradation 3, the sub-field 3 for displaying the luminous gradation 4, the sub-fields 1 and 3 for displaying the luminous gradation 5, the sub-fields 2 and 3 for displaying the luminous gradation 6, the sub-fields 1, 2 and 3 for displaying the luminous gradation 7, the sub-fields 4 in combination with those of the luminous gradations 0 to 7 for displaying the luminous gradation 8 through 15, the sub-fields 5 in combination with those of the luminous gradations 0 to 15 for displaying the luminous gradation 16 through 31, the sub-fields 6 in combination with those of the luminous gradations 0 to 32 for displaying the luminous gradation 32 through 63, the sub-fields 7 in combination with those of the luminous gradations 0 to 64 for displaying the luminous gradation 64 through 127, and the sub-fields 8 in combination with those of the luminous gradations 0 to 128 for displaying the luminous gradation 128 through 255, respectively.

All individual picture elements of the PDP display the half tones luminous level by combining the sub-fields to be illuminated in this manner. To obtain a luminous gradation of "173" for example, sub-fields to be illuminated are the sub-field 8 having a weighting of "128", the sub-field 6 having a weighting of "32", the sub-field 4 having a weighting of "8", the sub-field 3 having a weighting of "4" and the sub-field 1 having a weighting of "1". In this way, the PDP illuminates in response to the weighting (or illuminates a number of times according to the weighting), and the resulting luminous level (that humans perceive) is in proportion to an integrated sum of the illumminated time.

Using this method for displaying luminous half tones when showing still images, a desired half tones is realized without giving a disorderly impression (or any other problems) of picture quality. This is because humans perceive a luminous level of each picture element by properly adding the weight given to each of the sub-fields within an elapsing time period for one field because humans eyes watching an image are practically fixed upon the image.

With a display method using the sub-field method of the prior art, however, a problem exists with dynamic images in that quality of the picture deteriorates due to the appearance of noise in the form of pseudo contours (i.e., "pseudo contours in dynamic images") unique to the dynamic images. This is described, for example, in "New Category Contour Noise Observed in Pulse-Width-Modulation Moving Images", ITEJ Technical Report by The of Institute of Television Engineers of Japan (Vol. 19, No. 2, IDY95-21, p. 61–66). People watching dynamic images on a screen consciously perceive moving objects that are in motion in the screen. In the sub-field method, a luminous level of any particular spot (picture element) of an image being caught by human eyes is in proportion to a normal sum of the illuminated time or the number of pulses within the elapsed time of one field, if it is of the still images. In case of dynamic images, however, a luminous level of a particular spot ("picture element") of the image is for human eyes in proportion to the sum of the illuminated time or the number of pulses which occur within a locus of the moving image because the image in that spot moves before the luminous level completely finishes at the spot. That is, an addition of the illuminated time or the number of pulses is made through a plurality of the picture elements rather than a single picture element. Therefore the quality of pictures deteriorates, as the eyes do not perceive the luminous level of each picture element in the dynamic images as their normal luminous level. This deterioration of picture quality is conspicuously perceivable in images in which the luminous level gradually varies among adjoining picture elements such as human faces and the skin, and pseudo contour patterns similar to contour lines appear. This phenomenon is now described using the figures.

FIG. 31 shows a condition in which four adjoining picture elements, "a", "b", "c" and "d" illuminate along with a lapse of time (axis of abscissa). In this instance, the picture elements "a" and "b" illuminate in the sub-fields 1, 2, 3, 4, 5, 6 and 7, but do not illuminate in the sub-field 8. On the other hand, the picture elements "c" and "d" do not illuminate in the sub-fields 1, 2, 3, 4, 5, 6 and 7, but they do illuminate in the sub-field 8. This means that the luminous level of the picture elements "a" and "b" is "127" and the luminous level of the picture elements "c" and "d" is "128" in FIG. 31, giving a typical example of two groups of picture elements each having the luminous levels of "127" and "128" adjoining each other with only one luminous level difference.

If the image stands still and the user's eyes stay fixed, the user watches the luminescence of all sub-fields along an arrow marked "fixed eyes 127" in FIG. 31, and correctly integrates the illuminated time or the number of pulses so as to perceive a luminous level of the luminous level "127" at the picture element having the luminous level of "127" in a screen. Likewise, the user watches the luminescence of all sub-fields along an arrow marked "fixed eyes 128" and perceives a luminous level of the luminous level "128" at the picture element having the luminous levels of "128" in the screen.

On the other hand with the dynamic images, however, a disorder occurs in luminous gradations in an image formed on the retina, since the eyes follow the moving image which causes a deviation in position of the picture elements in relation to the corresponding sub-fields as the time elapses.

Consider, as an instance, that an image moves a distance of three picture elements during a period of one field. That is, a particular image on the screen moves from a spot of the picture element "a" to a spot of the picture element "d" within the lapse of time (duration) for one field. In this situation, the human eyes gaze at the picture element "a" at a time when the sub-field 1 is illuminating, then follow the moving image in response to a speed of the image, and move on to the picture element "d" with the anticipation of the move after the duration of one field. This move is shown by a dotted line toward the lower right in FIG. 31. The eyes move from an upper left part to a lower right part in FIG. 31. Consequently, the eyes perceive a brightness of "255" in the luminous level (which equals (1+2+4+8+16+32+64)+128), as they observe all of the sub-fields 1 through 7 of the picture elements "a" and "b" both of which have a luminous level of "127", and the sub-field 8 of the picture elements "c" and "d" which have a luminous level of "128".

Conversely, the eyes may perceive a luminous level of "0", in the luminous level, because they catch the sub-fields while none of them is illuminating when the eyes move from the picture element "d" to the picture element "a", or from a lower left part to an upper right part of FIG. 31. This phenomenon, in which human eyes watching a dynamic image perceive an unintended luminous level when they follow a movement of the image, becomes more conspicuous when the eyes fail to recognize the luminescence of sub-fields having especially large weight ("luminous level").

As described, the half tones displaying method of the prior art has a problem in that it may cause the user to perceive an unnaturalness as if there is a difference in luminous level between picture elements that in fact have an imperceptible difference, when watching the screen by following the image in motion.

SUMMARY OF THE INVENTION

Luminous half tones are displayed by superposing in time wise fashion a plurality of binary images which are individually assigned with a weight according to respective luminous level. A weight to be assigned to each binary image is selected so as to make an absolute value of the differences in weight between adjoining binary images, when all of the binary images are arranged in an ascending order, to be equal to or less than 6% of a total number of luminous gradations that can be displayed by superposing the plurality of binary images.

When the plurality of binary images are arranged in an ascending order, a weight is assigned to each of the binary images so that the difference in weight between the adjoining binary images becomes equal to or less than 6% of a total number of luminous gradations that can be displayed by superposing the plurality of binary images. This reduces a deviation of the luminous half tones from what is to be displayed by each of the picture elements even if users perceive a composition of the plurality of binary images that illuminate at various moments as the users' eyes move across the plurality of picture elements within a certain period of time.

In a further exemplary embodiment of the present invention, a weight is assigned to each of the binary images so that an absolute value of difference ("secondary difference") between two adjoining differences ("primary differences"), of which the difference is in weight between the adjoining binary images, becomes 3% of the total number of luminous gradations or less. This further reduces the deviation of luminous half tones from what is to be displayed by each of the picture elements. This reduction occurs even if users perceive a composition of the plurality of binary images that illuminate at various moments as the users' eyes move across the plurality of picture elements within a certain period of time.

In a further exemplary embodiment of the present invention, when the plurality of binary images are arranged in an ascending order, a weight is assigned to each of the binary images so that a mean value of the differences in weight ("primary differences") between the adjoining binary images positioned in the first half of the arrangement of all the binary images is smaller than a mean value of the primary differences between the adjoining binary images positioned in the latter half of the arrangement. This further reduces the deviation of luminous half tones from what is to be displayed by each of the picture elements even if observers perceive a composition of the plurality of binary images that illuminate at various moments as the observers' eyes move across the plurality of picture elements within a certain period of time.

In a further exemplary embodiment of the present invention, when the plurality of binary images are arranged in an ascending order, a weight is assigned on each of the binary images so that a mean value in a group of the differences in weight ("primary differences") between the adjoining binary images increase monotonously as a range of the group, which is to include the differences in weight (called "shifted mean value") between the adjoining binary images, is shifted one primary difference at a time beginning from the group of the first half of the binary images' arrangement toward the latter half of the arrangement. This further reduces the deviation of luminous half tones from what is to be displayed by each of the picture elements even if users perceive a composition of the plurality of binary images that illuminate at various moments as the users' eyes move across the plurality of picture elements within a certain period of time.

In a further exemplary embodiment of the present invention, when the plurality of binary images are arranged in an ascending order, a weight is assigned on each of the binary images so that the differences in weight ("primary difference") between the adjoining binary images monotonously increase from a side of the binary image of smallest weight toward a side of largest weight, so as to even further reduce the deviation of luminous half tones from what is to be displayed by each of the picture elements. This reduction occurs even if users perceive a composition of the plurality of binary images that illuminate at various moments as the users' eyes move across the plurality of picture elements within a certain period of time.

In a further exemplary embodiment of the present invention, a selection is made among the binary images with priority given to the smallest weight. The binary images are then combined to make any combination of the binary images that manifests the luminous half tones so as to spread the luminescence into more binary images, thereby obtaining a better gradational clarity in both still images and dynamic images and reducing the deviation of luminous half tones from what is to be displayed by each of the picture elements. This reduction occurs even if users perceive a composition of the plurality of binary images that illuminate at various moments as the users' eyes move across the plurality of picture elements within a certain period of time.

In a further exemplary embodiment of the present invention, the picture elements are caused to be ruminate by superposing in time wise fashion the binary images with the weight of the binary images in either an ascending order or a descending order. This reduces the deviation of luminous half tones from what is to be displayed by each of the picture elements. This reduction occurs even if users perceive a composition of the plurality of binary images that illuminate at various moments as the users' eyes move across the plurality of picture elements within a certain period of time.

In an exemplary embodiment of the present invention, luminous half tones are displayed by superposing in time wise fashion twelve binary images in which a proportion of the weights to be assigned to each of the binary images are individually specified, so as to reduce the deviation of luminous half tones from what is to be displayed by each of the picture elements. This reduction occurs even if users perceive a composition of the plurality of binary images that illuminate at various moments as the users' eyes move across the plurality of picture elements within a certain period of time.

In an exemplary embodiment of the present invention, luminous half tones are displayed by superposing in time wise fashion eleven binary images in which a proportion of the weights to be assigned to each of the binary images are individually specified. This reduces the deviation of luminous half tones from what is to be displayed by each of the picture elements even if users perceive a composition of the plurality of binary images that illuminate at various moments as the users' eyes move across the plurality of picture elements within a certain period of time.

In an exemplary embodiment of the present invention, luminous half tones are displayed by superposing in time wise fashion ten binary images in which a proportion of the weights to be assigned to each of the binary images are individually specified. This reduces the deviation of luminous half tones from what is to be displayed by each of the picture elements even if users perceive a composition of the plurality of binary images that illuminate at various moments as the users' eyes move across the plurality of picture elements within a certain period of time.

BRIEF DESCRIPTION OF THE DRAWINGS

FIG. 5 is a diagram depicting different weightings given on the basis of luminous level to the sub-fields for the purpose of comparison in accordance with the first exemplary embodiment of the present invention;

FIG. 15 is a diagram depicting weightings given on the basis of luminous level to other sub-fields in accordance with the third exemplary embodiment of the present invention;

FIG. 17 is a first diagram depicting a combination of selected sub-fields accordance with in the forth exemplary embodiment of the present invention;

FIG. 18 is a second diagram depicting a combination of selected sub-fields in accordance with the forth exemplary embodiment of the present invention;

FIG. 24 is a first diagram depicting weightings given on the basis of luminous level to sub-fields in accordance with the fifth exemplary embodiment of the present invention;

FIG. 25 is a second diagram depicting weightings given on the basis of luminous level to sub-fields in accordance with the fifth exemplary embodiment of the present invention;

FIG. 26 is a third diagram depicting weightings given on the basis of luminous level to sub-fields in accordance with the fifth exemplary embodiment of the present invention;

FIG. 27 is a fourth diagram depicting weightings given on the basis of luminous level to sub-fields in accordance with the fifth exemplary embodiment of the present invention;

FIG. 28 is a fifth diagram depicting weightings given on the basis of luminous level to sub-fields in accordance with the fifth exemplary embodiment of the present invention;

DESCRIPTION OF THE PREFERRED EMBODIMENTS

First Exemplary Embodiment

A first exemplary embodiment of the present invention is described below with reference to FIG. 1 through FIG. 8.

Figure 2:
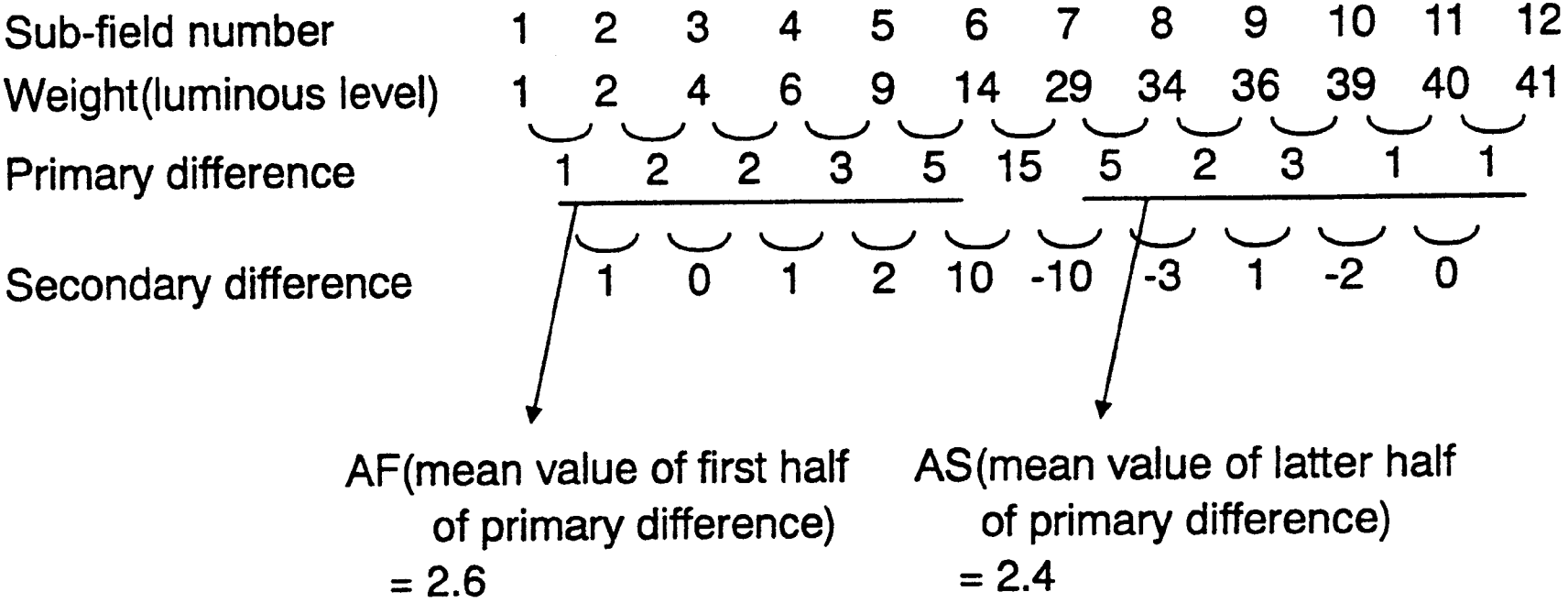
FIG. 2 is a diagram depicting weightings given on the basis of luminous level to each sub-field in accordance with the first exemplary embodiment of the present invention.

FIG. 2 shows an example in which one field comprises twelve sub-fields. A first line indicates sub-field numbers and a second line indicates weightings assigned to the individual sub-fields. The sub-fields are arranged in an ascending order of the weights as a matter of convenience. A third line indicates values of primary difference (which is the difference of weights between the adjoining sub-fields, i.e. the difference of weights between the adjoining binary images).

The weights, which are given to the individual sub-fields according to the sub-field numbers, are 1, 2, 4, 6, 9, 14, 29, 34, 36, 39, 40 and 41.

Picture signals can present 256 gradations of luminous tone of eight-bit coding by combinations of binary images composed of the twelve sub-fields.

Figure 1:
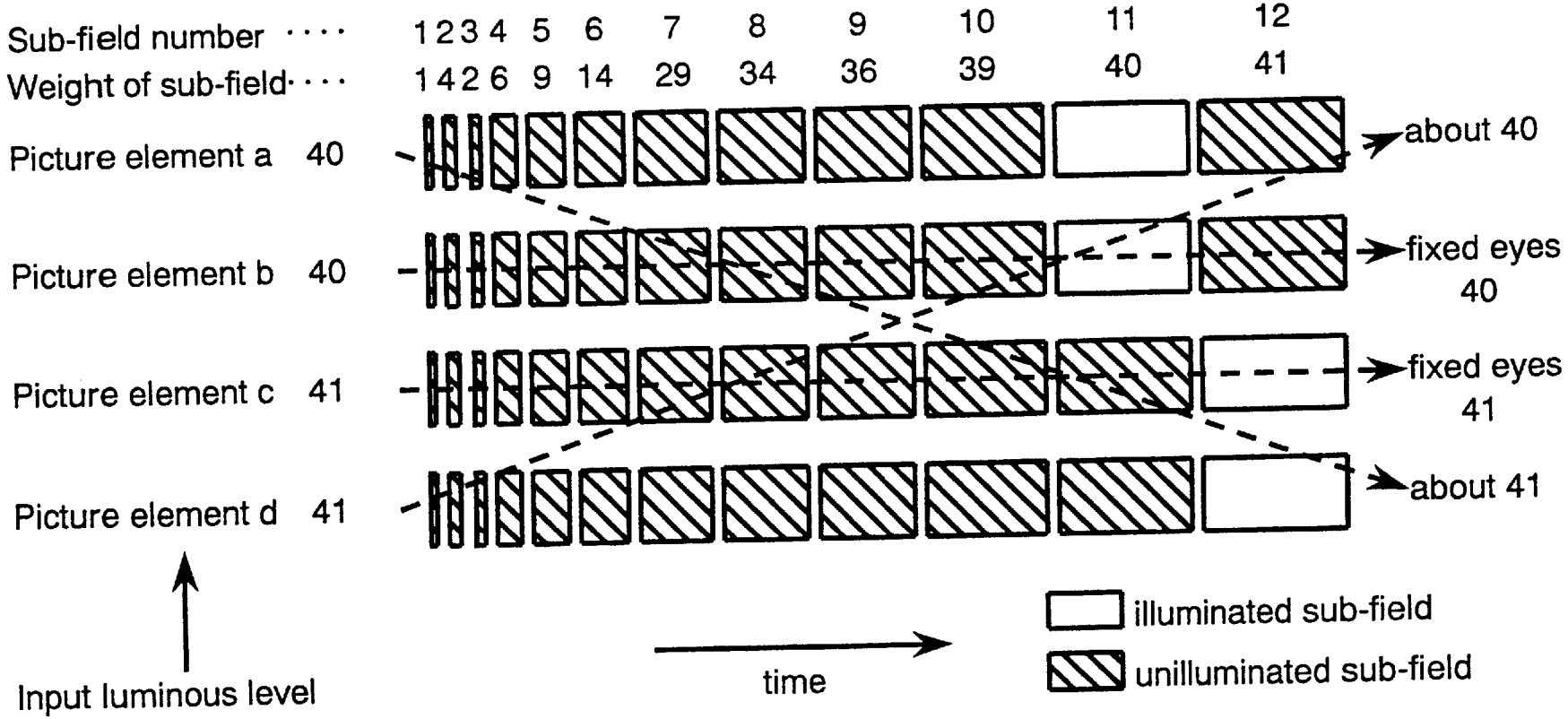
FIG. 1 is a diagram showing illumination of sub-fields. An improvement of picture quality with a dynamic image is depicted in accordance with a first exemplary embodiment of the present invention.

FIG. 1 depicts an order of illuminating the sub-fields and a state of illuminations based on the weightings assigned to the sub-fields as indicated in FIG. 2. The figure shows four picture elements, "a", "b", "c" and "d" that contiguously form in a line (a same phenomenon and effect, as described below, are produced with the line formed vertically, horizontally and diagonally). A horizontal length of each of tetragons indicates duration of illumination (or a frequency of illuminations) within each sub-field, with blank tetragons being the sub-fields of an ON state and shaded tetragons being the sub-fields of an OFF state. Empty areas between the tetragons are nonluminant periods that are collateral with the individual sub-fields.

This is an instance in which the picture elements "a", "b", "c" and "d" form contiguously in a line, and that a luminous level of the picture elements "a" and "b" is "40" and that of the picture elements "c" and "d" is "41". An extent of difference between a luminous level perceived by human eyes pursuing a dynamic image and a proper luminous level that this instance produces is described below.

A reason for selecting the luminous levels of "40" and "41" is that the difference between a luminous level perceived by human eyes pursuing a dynamic image and a proper luminous level intended to display becomes largest when an illumination of the sub-fields, which are assigned with biggest weights among the twelve sub-fields, are turned ON and Off. Although there exists several ways of selection or combination of the sub-fields for displaying any luminous level, a preference is given to larger sub-fields for this selection.

The present invention is characterized by assigning weightings to the individual sub-fields so that the primary differences become equal to or less than 6% of 256, or a total number of gradations, i.e., "15" or less, when the sub-fields are so arranged as to form the weights in an ascending order.

Though the sub-fields are arranged in an ascending order of the weights in FIG. 2, a point to be made here is that the order of aligning and illuminating the sub-fields in time wise fashion is not restricted to the ascending order of the weights when display devices such as a PDP are activated in practice. That is to say, unlike FIG. 1, which also shows the order of actual illuminations, an arrangement in FIG. 2 is made in the ascending order for a matter of convenience for making understanding easier. As an example of order of sub-fields which differs from that of FIG. 2, FIG. 1 shows a case wherein illuminations are made in an order of 1, 4, 2, 6, 9, 14, 29, 34, 36, 39, 40 and 41 as depicted by the weight of sub-fields.

The primary differences in the third line of FIG. 2 are the differences in weight between the adjoining sub-fields, and that the primary difference between the sub-fields 1 and 2 is 1 (=2−1) and that of between the sub-fields 4 and 5 is 3(=9−6), for examples. Likewise, the primary differences are in an order of 1, 2, 2, 3, 5, 15, 5, 2, 3, 1 and 1, from the left to the right in FIG. 2.

A maximum value of the primary differences in this embodiment is "15" which is the primary difference between the sub-fields 6 and 7, and this value satisfies a condition of being 6% or less, i.e., "15" or less, of the 256 luminous gradations.

There is described below, referring to FIG. 1, how to present the luminous gradations by combining the sub-fields, which are given with the weightings as stated above. Humans watching a display device such as TV, etc. perceive luminous level of the luminous levels "40" and "41" properly when their eyes stay still because they add luminous level of each sub-field on every picture elements correctly along an arrow denoted as "fixed eyes" in FIG. 1. On the contrary, with a dynamic image, for instance, if the image moves a distance of three picture elements during the duration of one field, the eyes follow the movement, and move on from the picture element "a" to a position of the picture element "d" within the lapse of time for one field. A slanting arrow in FIG. 1 is a locus indicating the movement of eyes. The eyes fail to recognize the luminous level as "41" instead of "40" or "40" instead of "41" due to a deviation of the luminous level from what the eyes ought to catch, because the humans add luminous level of the sub-fields on each of the picture elements "a", "b", "c" and "d" that illuminate in a different timing along the locus as the eyes move.

Figure 3:
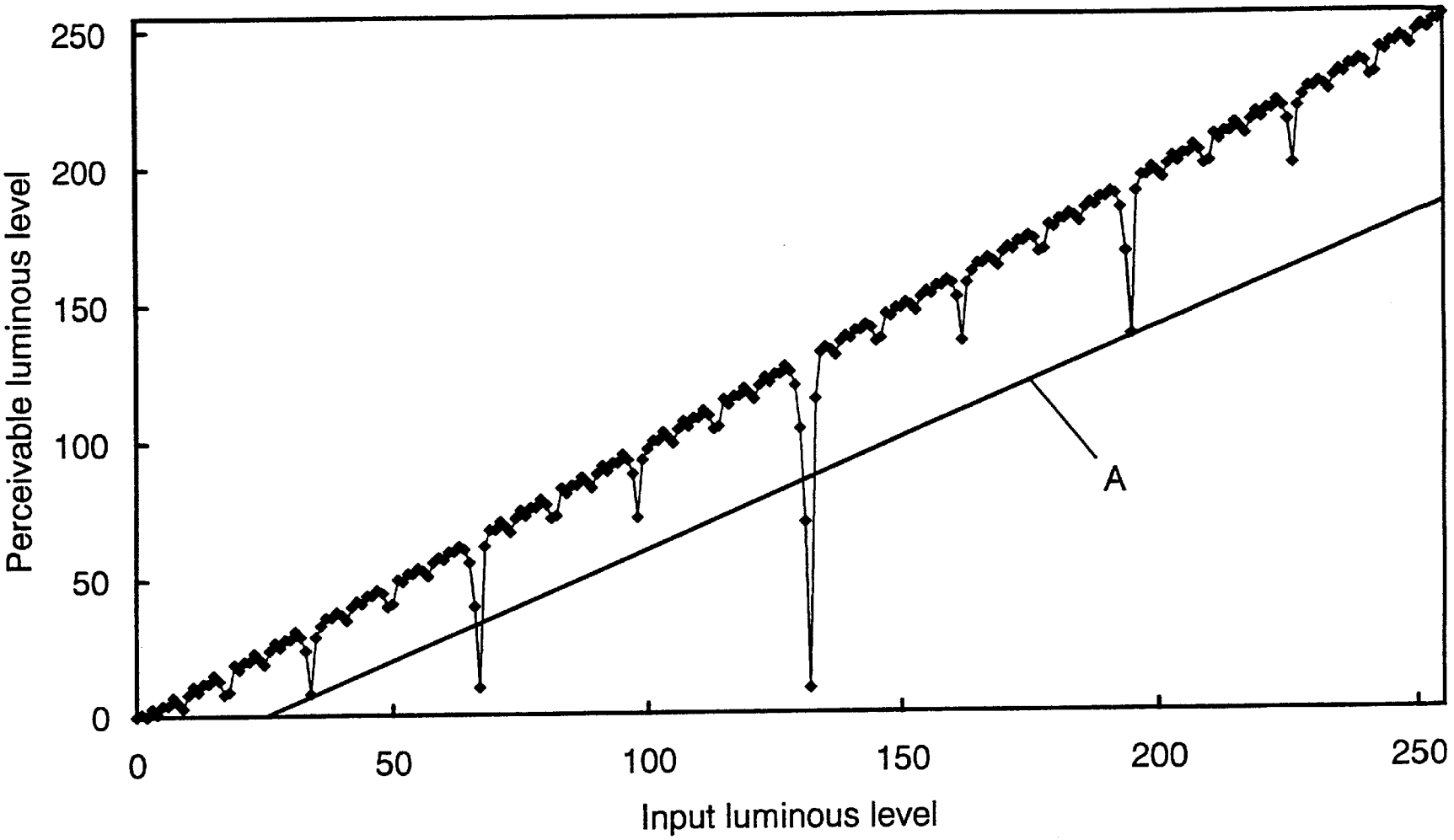
FIG. 3 PRIOR ART
FIG. 3 is a graphic chart showing a relationship between the luminous level input and the perceivable luminous level. This graphic chart depicts a problem of the picture quality with a dynamic image in the prior art.
Figure 4:
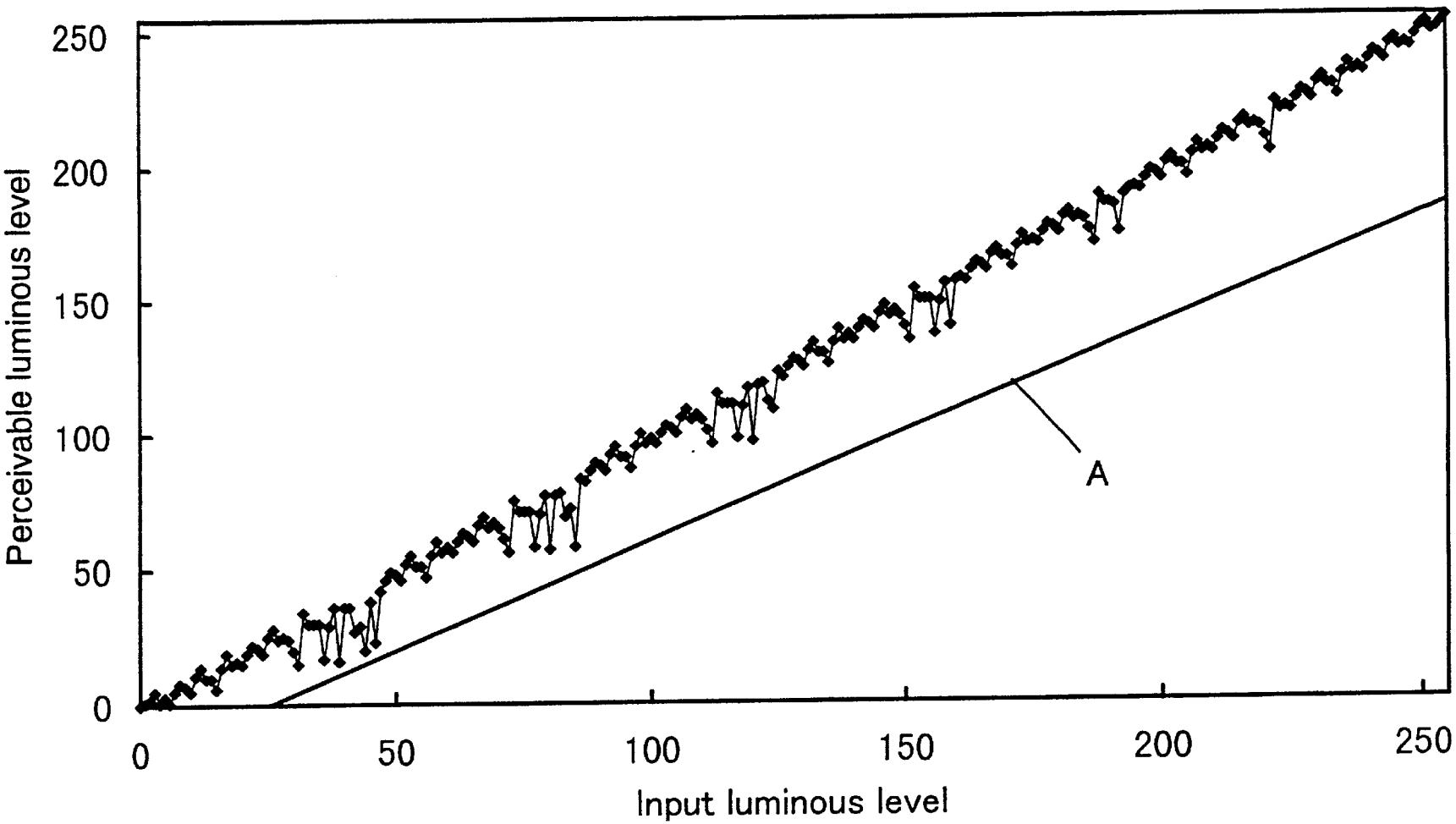
FIG. 4 is a graphic chart showing a relationship between the luminous level input and the perceivable luminous level. An improvement of the picture quality with a dynamic image is depicted when the weightings on the basis of luminous level are given to the sub-fields in accordance with FIG. 2.
Figures 30A, 30B:
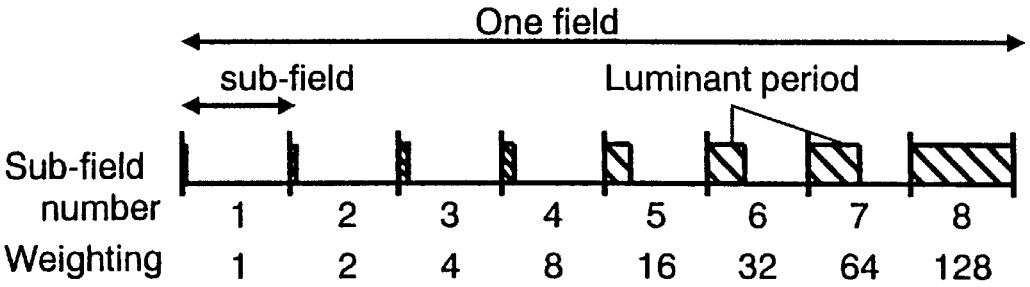
FIG. 30A PRIOR ART
FIG. 30B PRIOR ART
FIGS. 30A and 30B are diagrams depicting luminous weightings and a combination of selected sub-fields in accordance with the prior art.
Figure 31:
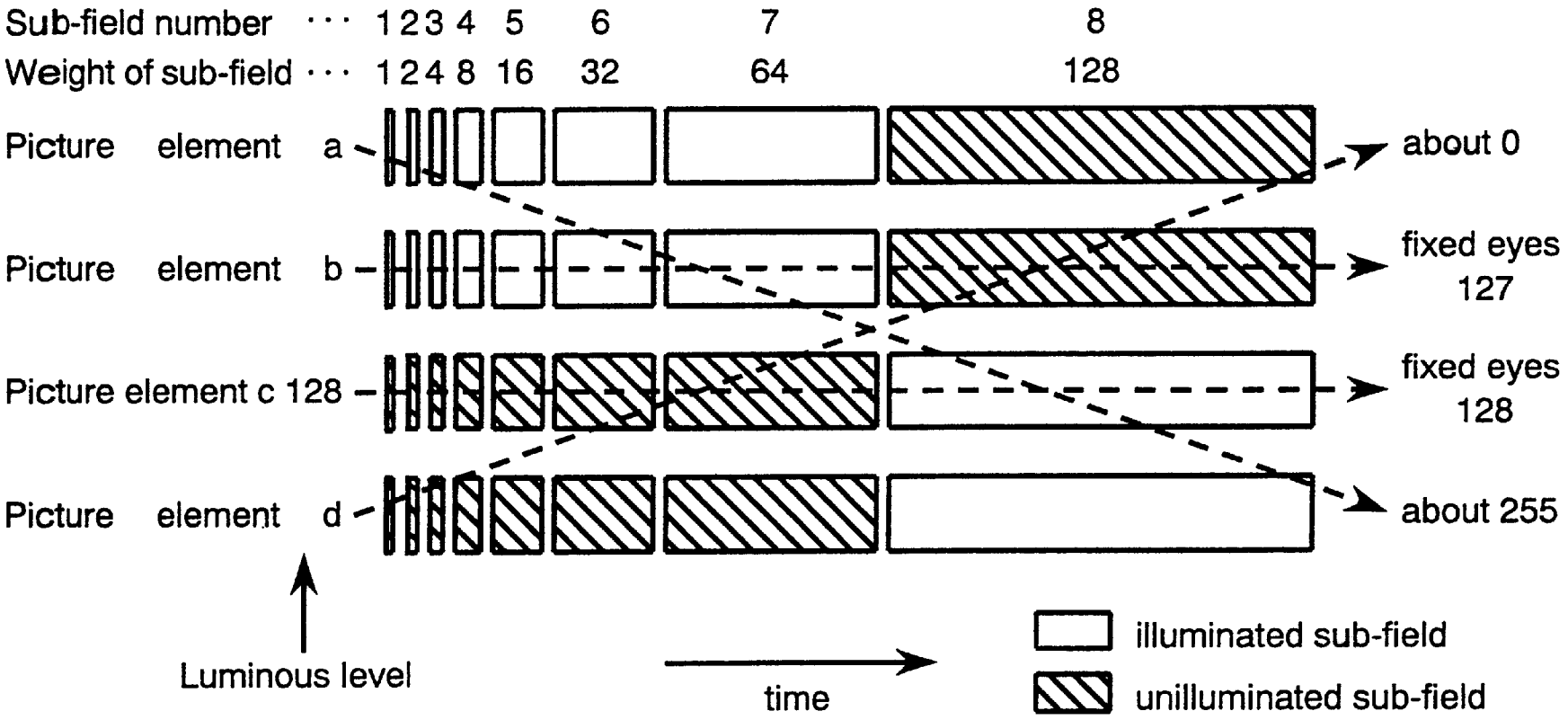
FIG. 31 PRIOR ART
FIG. 31 is a diagram showing illumination of sub-fields, which depicts a problem of the picture quality with a dynamic image in the prior art.

A deviation of perceivable luminous level from the proper luminous level is, however, small as compared to the prior art technology which displays the luminous half tones using eight sub-fields as depicted in FIGS. 30 and 31. FIG. 3 and FIG. 4 show an outline. These figures show a relationship between the luminous level input and the perceivable luminous level. An input image signal used here, as an image signal, is a ramp signal of which luminous level varies horizontally from "0" to "255" by one step at a time. This ramp signal is also a signal to move horizontally at a speed of 6 picture-elements/field.

Using this signal, a calculation is made below of the deviation of perceivable luminous level from the proper luminous level, which occurs when predetermined weights are assigned to the individual sub-fields according to the luminous level.

Here, the deviation of perceivable luminous level from the proper luminous level will be referred to as "deviation of luminous level". It has been confirmed that information obtained from this calculation is consistent with a result of assessment actually performed for picture images by eyes.

FIG. 3 shows a relationship between the luminous level input and the perceivable luminous level when the signal is input using the prior art method in which eight sub-fields are assigned with weightings as shown in FIG. 31.

The relationship between the luminous level input and the perceivable luminous level shall be rectilinear if there is not a false recognition as cited above. In reality, however, the perceivable luminous level deviates significantly from the proper level at several points of the input luminous level due to the false recognition.

FIG. 4 shows a relationship between the luminous level input and the perceivable luminous level in case of the present embodiment in which twelve sub-fields are assigned with weightings as shown in FIG. 1.

By comparing FIG. 4 with FIG. 3, it is obvious that the method of the present embodiment depicted in FIG. 4 reduces a magnitude of the deviation ("peak value") from the proper value.

Comparisons and verifications are made between the magnitude of deviations and picture quality, i.e., an appearance of pseudo contours in dynamic images using various kinds of dynamic image (e.g., "A list of images for evaluating picture quality of dynamic image in PDP" published in 1996 by the PDP Development Council) including an image of the ramp signal. As a result, it has been found in the prior art of FIG. 3 that there is a close relationship between the peak value of deviations of luminous level and appearance of the pseudo contours in dynamic images, and that an appearance of the pseudo contours is narrowly permissible for viewing, if the deviations of luminous level are equal to or smaller than peak values that are observed near luminous levels of 30 and 190. For this reason, a "Line A", which connects these two points of the peak values, is used as an index of a very permissible limit for the pseudo contours in dynamic images. The permissible "Line A" is shown in FIG. 3. It is known that humans' ability for distinguishing light and darkness (a ratio of a difference in luminous level "dL" to a luminous level "L", or dL/L) in bright vision is consistent independently of an absolute value of luminous level. Therefore, the "Line A" is supposed to meet the origin. In display devices, however, the "Line A" does not meet the origin at a luminous level of equal to or less than 30, because the humans' ability for distinguishing light and darkness declines due to the visual characteristic shifting from bright vision to twilight vision (or, it is believed that an ability for distinguishing light and darkness declines for a part of relatively low luminous level when the part of low luminous level is observed together with a coexisting part of relatively high luminous level simultaneously). As a result, the "Line A" becomes a straight line as shown in FIG. 3.

The description below is based on this permissible "Line A".

When the sub-fields are arranged in an ascending order for convenience, based upon the prior condition, there is a tendency for an appearance of the pseudo contours in dynamic images to become less, as the difference in weight between the adjoining sub-fields, or the primary difference, is smaller. And, it has been known that a permissible picture quality for dynamic images is ensured if the primary differences become approximately 6% of the total number of luminous gradations or less, since the deviations of luminous level remain within the "Line A" and an appearance of the pseudo contours in dynamic images decreases.

As shown in FIG. 1, an order of illuminating the sub-fields is not restricted to an ascending order or a descending order of the weights. On the other hand, there are several ways of redundancy in combining which of the twelve sections of weight in order to show any one of the luminous levels. The combination of the present embodiment is selected with a priority given intentionally to the sub-fields having large weighting so as to incur large deviations of luminous level at low luminous level. Even under such a condition, the picture quality becomes permissible, as stated before, if the primary difference is retained at 6% of the total number of luminous gradations or less.

Figure 6:
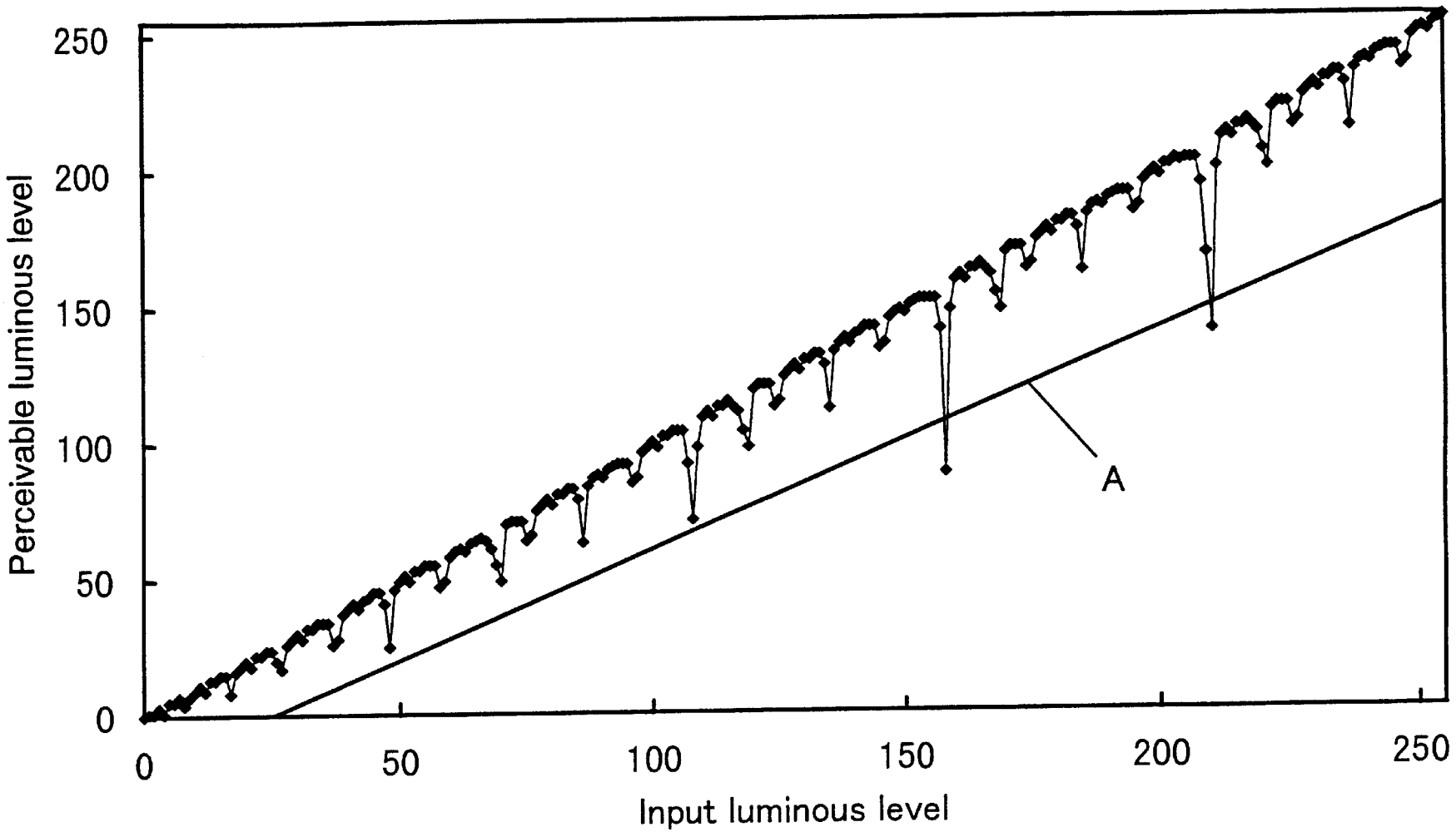
FIG. 6 is a graphic chart showing a relationship between the luminous level input and the perceivable luminous level. This graphic chart depicts a state of the picture quality with a dynamic image when the weightings on the basis of luminous level are given to the sub-fields in accordance with FIG. 5.

In FIGS. 5 and 6, weights to be assigned to the individual sub-fields are selected as follows. The weights ("luminous levels") for the sub-fields 1 through 12 are 1, 2, 4, 8, 9, 10, 11, 21, 38, 49, 50 and 52, as depicted in FIG. 5. And the primary differences are 1, 2, 4, 1, 1, 1, 10, 17, 11, 1 and 2.

FIG. 6 shows a relationship between the luminous level input and the perceivable luminous level when the weightings as noted above are assigned to the sub-fields, and the same ramp signal as used in FIG. 3 is inputted. In FIG. 6, a sequence of illuminating the sub-fields is in an ascending order.

In case of the weightings noted in FIG. 5, a maximum value of the primary differences becomes "17", which is approximately 7% of the 256 luminous gradations so that deviations of luminous level exceed the permissible level. It is, therefore, obvious that the value of 6% as previously cited is a significant value when compared to FIGS. 5 and 6.

Figure 7:
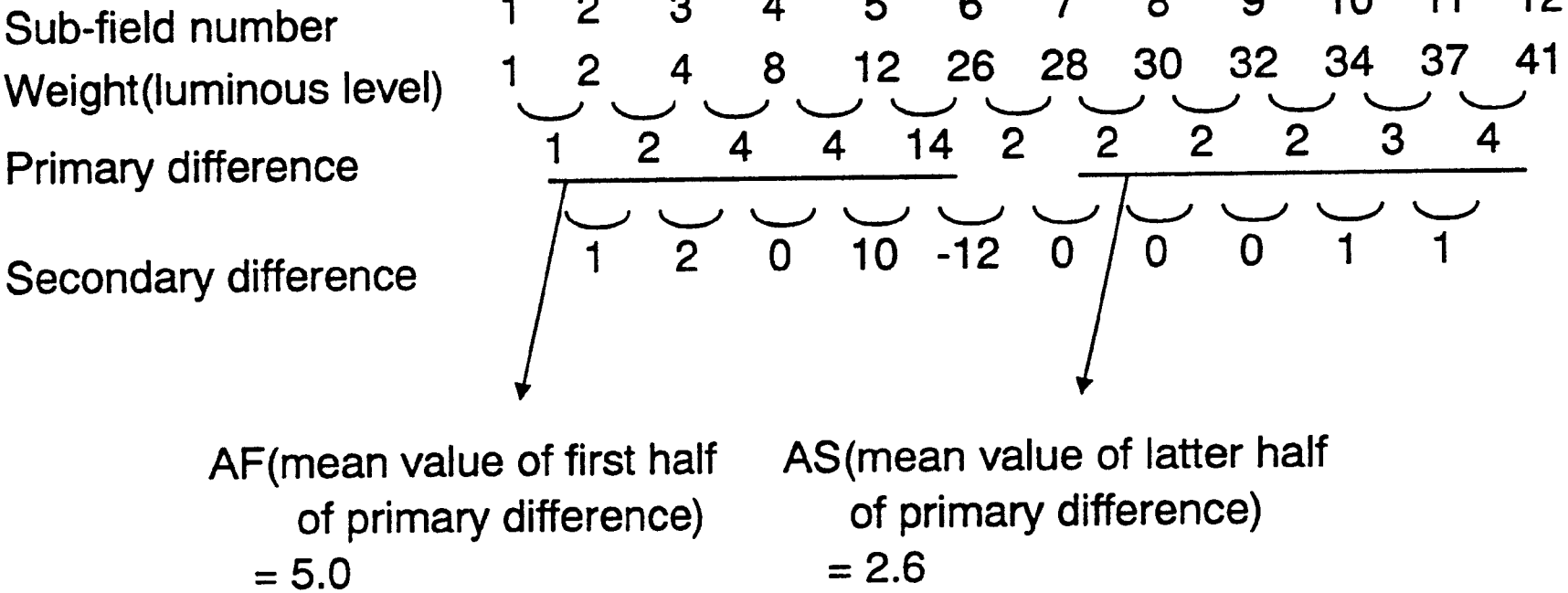
FIG. 7 is a diagram depicting weightings given on the basis of luminous level to other sub-fields in accordance with the first exemplary embodiment of the present invention.
Figure 8:
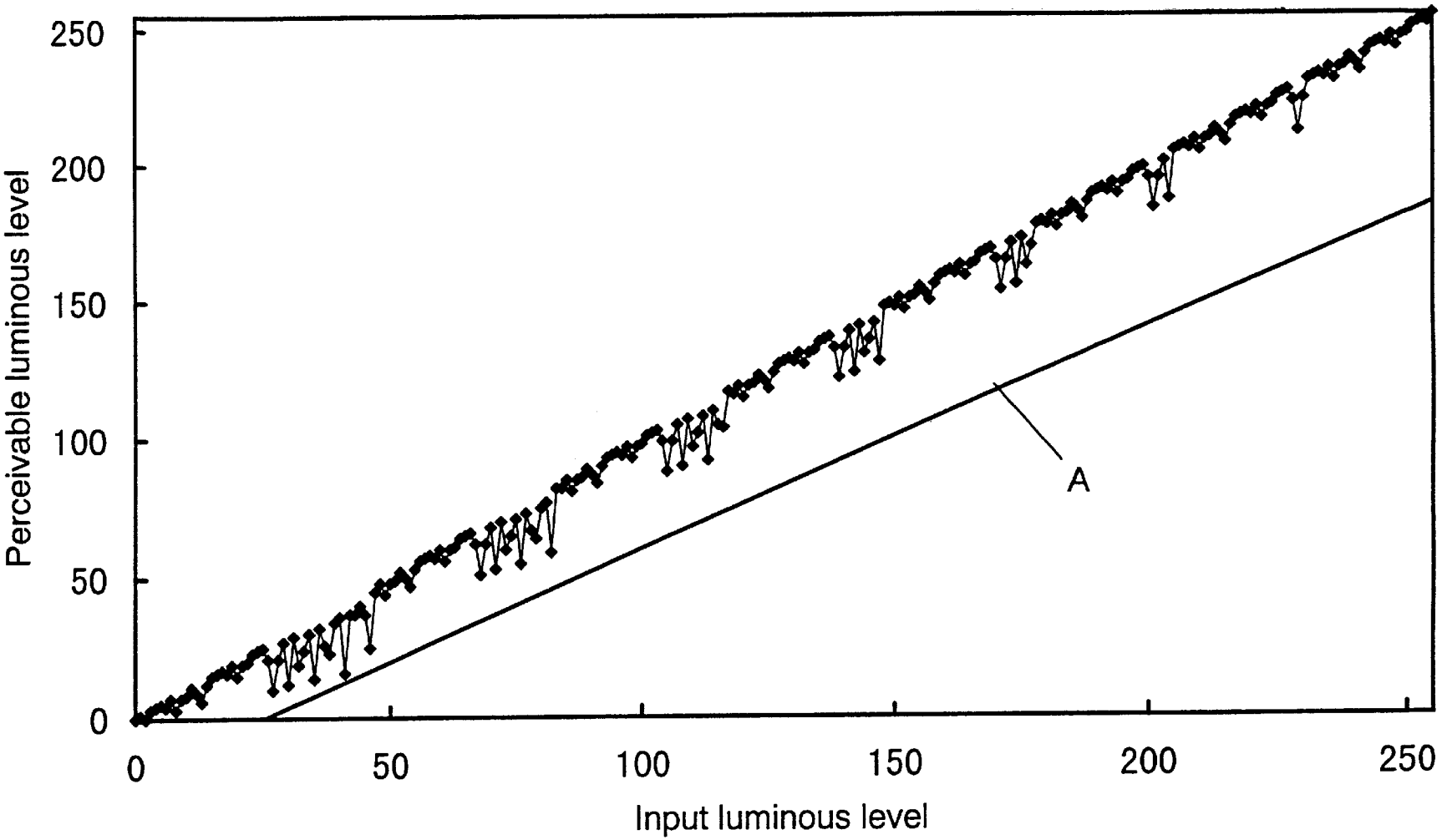
FIG. 8 is a graphic chart showing a relationship between the luminous level input and the perceivable luminous level. This graphic chart depicts a state of an improvement of the picture quality with a dynamic image when the weightings on the basis of luminous level are given to the sub-fields in accordance with FIG. 7.

FIGS. 7 and 8 depict another example. In FIG. 7, the weights ("luminous levels") assigned to the sub-fields 1 through 12 are 1, 2, 4, 8, 12, 26, 28, 30, 32, 34, 37 and 41. And the primary differences derived from these weights are 1, 2, 4, 4, 14, 2, 2, 2, 2, 3 and 4.

FIG. 8 shows a relationship between the luminous level input and the perceivable luminous level when the weightings as noted above are assigned to the sub-fields, and the same ramp signal as used in FIG. 3 is inputted.

In case of the weightings noted in FIG. 7 and FIG. 8, a maximum value of the primary differences is "14", which is approximately 5.5% of the 256 luminous gradations, and is less than "15" so that deviations of luminous level are within the permissible level of "Line A". Thus, a permissible picture quality for dynamic images is ensured since an appearance of the pseudo contours in dynamic images is decreased as compared with FIGS. 5 and 6, of which a maximum value of the primary differences is "17".

In case of the weightings noted in FIG. 28, a maximum value of the primary differences is "12", which is approximately 4.7% of the 256 luminous gradations. Also, in case of the weightings noted in FIGS. 9 and 27, a maximum value of the primary differences is "11", which is approximately 4.3% of the 256 luminous gradations. In both cases, deviations of luminous level are within the permissible level of "Line A" as they are less than "15" of FIG. 2. Hence, a permissible picture quality for dynamic images is ensured since an appearance of the pseudo contours in dynamic images is decreased further as compared to FIGS. 5 and 6, of which a maximum value of the primary differences is "17".

Figure 10:
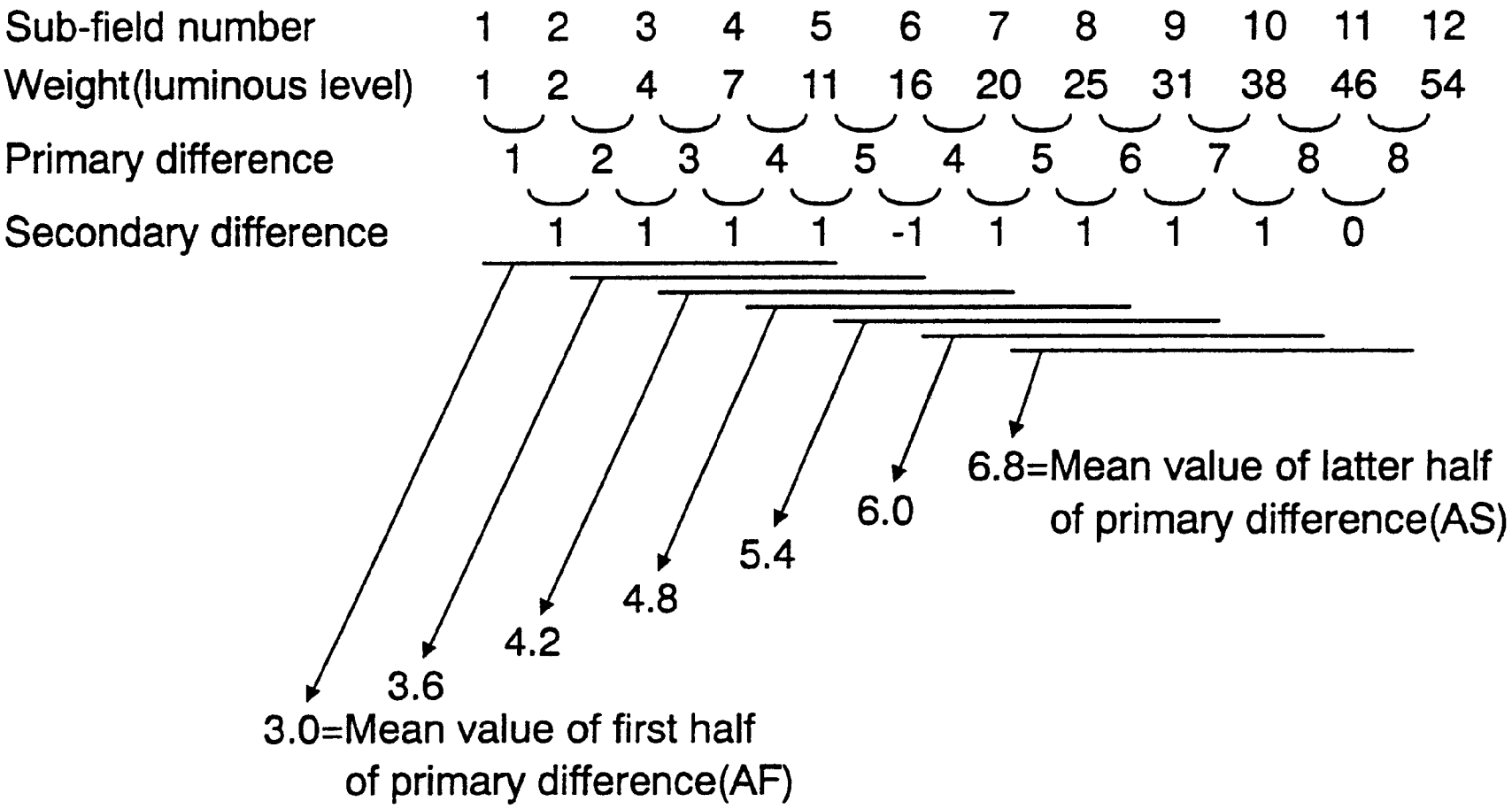
FIG. 10 is a diagram depicting weightings given on the basis of luminous level to other sub-fields in accordance with the second exemplary embodiment of the present invention.

Further, in case of the weightings noted in FIGS. 10, 25 and 26, a maximum value of the primary differences is "8", which is approximately 3.1% of the 256 luminous gradations, and is far less than "15" of FIG. 2 so that deviations of luminous level are within the permissible level of "Line A". A fine picture quality for dynamic images is thus ensured since an appearance of the pseudo contours in dynamic images is further decreased as compared to the case of FIGS. 5 and 6 whose maximum value of the primary differences is "17".

Furthermore, in case of the weightings noted in FIGS. 15 and 24, a maximum value of the primary differences is 37 7", which is approximately 2.7% of the 256 luminous gradations. This is by far a smaller value than "15" of FIG. 2 so that deviations of luminous level are within the permissible level of "Line A". An excellent picture quality for dynamic images is thus ensured because an appearance of the pseudo contours in dynamic images is decreased extensively as compared to the maximum value of primary differences of "17" in the case of FIGS. 5 and 6.

Second Exemplary Embodiment

Figure 9:
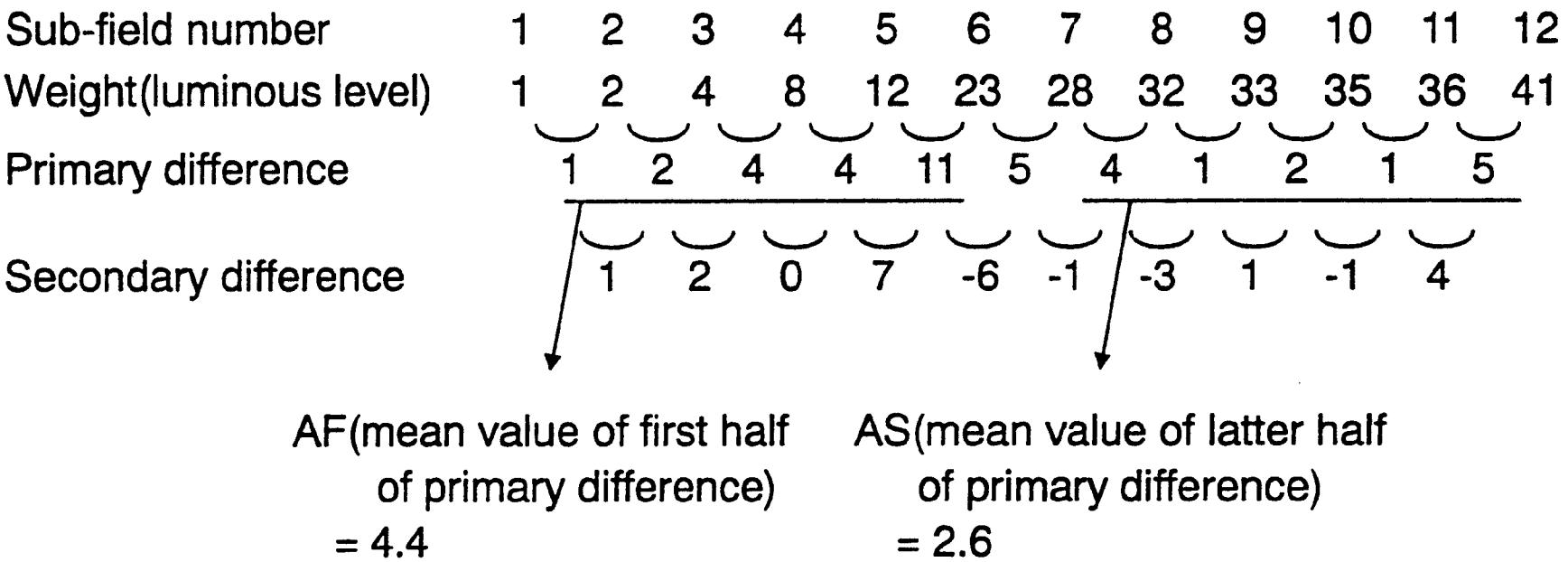
FIG. 9 is a diagram depicting weightings given on the basis of luminous level to sub-fields in accordance with a second exemplary embodiment of the present invention.

A second exemplary embodiment of the present invention is now described by referring to FIG. 9.

In FIG. 9 the weights, each of which is assigned to an individual sub-field according to the sub-field numbers, are 1, 2, 4, 8, 12, 23, 28, 32, 33, 35, 36 and 41, and primary differences are 1, 2, 4, 4, 11, 5, 4, 1, 2, 1 and 5. These primary differences are equal to or below "15", or 6% of the 256 luminous gradations.

The numerals in a fourth line of FIG. 9 are secondary differences, which show differences between the adjoining primary differences. For example, a difference of "1", which is derived from two primary differences of "1" and "2", which are differences between the sub-field 1 and the sub-field 2, and the sub-field 2 and the sub-field 3 respectively, is the secondary difference. The secondary differences in FIG. 9 are, from the left to the right, 1, 2, 0, 7, −6, −1, −3, 1, −1 and 4.

The present embodiment is characterized by assigning weights to the individual sub-fields so that an absolute value of the secondary differences becomes 3% of the 256 luminous gradations or less, i.e., "7" or less.

An object for the above weightings is to permit the primary differences between the sub-fields of smaller weight to become smaller and the primary differences between the sub-fields of larger weight to become greater by assigning weights to the individual sub-fields so as to maintain a variation of the primary differences to be relatively small in addition to maintaining the primary differences at equal to or less than 6% of the total luminous gradations as well as the primary differences to have a tendency to increase as they come toward the end of the alignment in an ascending order.

For a comparison purpose, the weightings of the sub-fields shown in the first embodiment in FIG. 2 is considered as an example. In FIG. 2, the primary differences suddenly increase to "15" between the sub-fields 6 and 7 from values of "5" or less, and decrease again to small values in the latter half. The secondary differences between fifth and sixth primary differences and between the sixth and seventh primary differences are "10" and "−10" respectively, and that the absolute value of these secondary differences indicates a value equivalent to approximately 4% of the 256 luminous gradations.

In FIG. 9, on the other hand, a sudden increase of the primary difference to "15" as found in FIG. 2 is avoided, and the primary differences in the latter half are relatively large as compared to that of FIG. 2, whereas the primary difference is risen to "11" between the sub-fields 5 and 6. The secondary difference in this case is increased to a maximum value of "7" between two of the primary differences, which are "4" between the sub-fields 4 and 5 and "11" between the sub-fields 5 and 6, yet this maximum value remains within 3% of the total luminous gradations.

Figure 29:
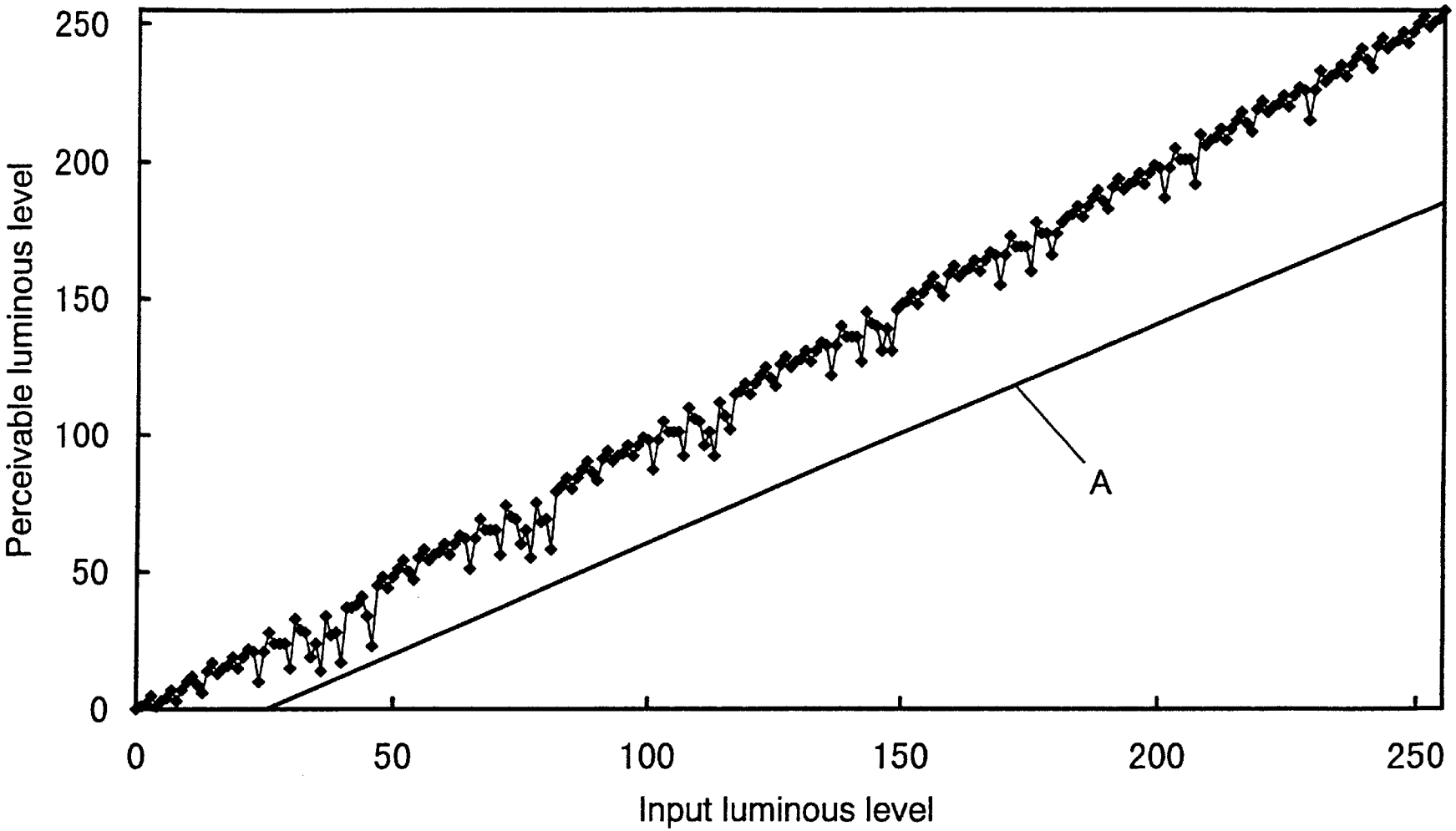
FIG. 29 is a graphic chart showing a relationship between the luminous level input and the perceivable luminous level, in accordance with FIG. 9.

As previously stated, FIG. 4 shows a result of calculating deviations of the perceivable luminous level from the proper luminous level (abbreviated as "deviation of luminous level" as cited above), in which the deviations are caused on an inputted ramp signal by a composition of the sub-fields, which are assigned with weightings as depicted in FIG. 2 of the first embodiment. FIG. 29 shows a result of calculating deviations of luminous level caused on the inputted ramp signal by a composition of the sub-fields, which are assigned with weightings as depicted in FIG. 9 of the present exemplary embodiment.

When FIG. 4 and FIG. 29 are compared, peak values of the deviation of luminous level of FIG. 29, of which weightings are so assigned as to keep the secondary differences 3% of the total luminous gradations or less as shown in FIG. 9, are slightly smaller in general, and a rate of the improvement is more significant in an area of low luminous level. This improvement is evaluated for further clarification by using a mean-square deviation as a quantitative index. A mean-square deviation is calculated by:

$$[\{\Sigma_{1/2}(\text{perceivable luminous level } i - \text{inputted luminous level } i)^2\}/N]$$

where N is a number of data to be included in the calculation.

When mean-square deviations of respective ranges are calculated for the deviations of luminous level shown in FIG. 4 and FIG. 29, they are:

| | FIG. 4 | FIG. 29 |
|---|---|---|
| Range of whole luminous levels | 6.7 | 6.4 |
| Range of low luminous levels | 8.0 | 7.5 |
| Range of high luminous levels | 5.2 | 5.0 |

wherein the range of calculation include:

range of whole luminous levels: luminous levels of "0" to "255"

range of low luminous levels: luminous levels of "0" to "127", and range of high luminous levels: luminous levels of "128" to "255".

From the above result, it is known that the deviations of luminous level are reduced in general, and a rate of the improvement is more significant in the range of low luminous level.

This method of making secondary differences small is verified by way of adding weights of the individual sub-fields along a movement of eyes, which is used in verification of the first embodiment.

Examples presented here are, in a viewpoint of showing an effectiveness comprehensibly, a case in which a maximum value among the absolute values of secondary difference shown in FIG. 7 is "12", and another case in which a maximum value among the absolute values of secondary difference shown in FIG. 10 is as small as "1".

The secondary differences shown in the fourth line of FIG. 7 are 1, 2, 0, 10, −12, 0, 0, 0, 1 and 1, from the left to the right.

On the other hand, the secondary differences shown in the fourth line of FIG. 10 are 1, 1, 1, 1, −1, 1, 1, 1, 1 and 0, from the left to the right, and a maximum value of the secondary differences is 3% of the 256 luminous gradations or less, i.e., "7" or less.

Between these two examples of FIG. 7 and FIG. 10, attention is paid to a luminous level of the sub-field 6, which has the largest weighting, at a time when the luminous level turns on from an off state, including the sub-field 6 where an effect of the secondary difference begins to appear. These are depicted by an instance of four picture elements, "a", "b", "c" and "d", aligned side by side in FIGS. 11A and 11B. A combination of the sub-fields when showing any luminous level is also described here using an example of preferentially selecting sub-fields of large weighting. Accordingly, attention is paid to a boundary of change from a luminous level of "25" to a luminous level of "26" corresponding to FIG. 7 and to a boundary of change from a luminous level of "15" to a luminous level of "16" corresponding to FIG. 10. While the abscissa in FIGS. 11A and 11B denotes the axis for time, the example shows a sequence of illuminating the sub-fields as being neither in an ascending order nor in a descending order.

Figure 11A:
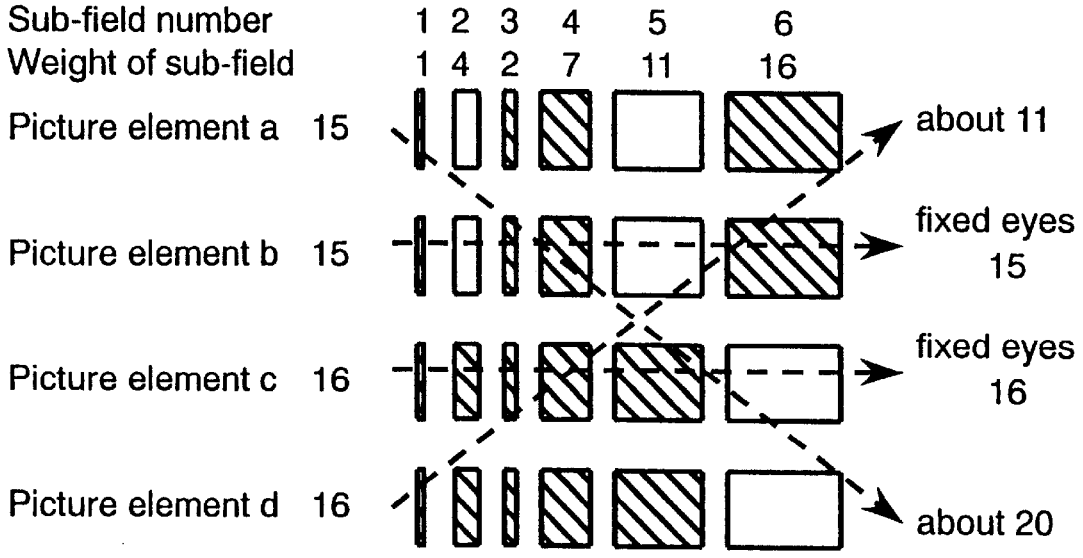
FIGS. 11A and 11B are diagrams showing illumination of sub-fields. These diagrams depict an improvement of picture quality with a dynamic image in accordance with the second exemplary embodiment of the present invention.

FIG. 11A corresponds to the weightings of FIG. 10, in which a luminous level of "15" is displayed by turning on sub-fields 2 and 5, and a luminous level of "16" by turning on only sub-field 6. Also, FIG. 11B corresponds to the weightings of FIG. 7, in which a luminous level of "25" is displayed by turning on sub-fields 1, 2, 4 and 5, and a luminous level of "26" by tuning on only sub-field 6. When eyes stay still under the above illuminating condition, the eyes perceive the luminous levels properly since luminous levels of every picture element are correctly added from the sub-field 1 to the sub-field 6, as indicated by an arrow denoted as "fixed eye".

Figure 11B:
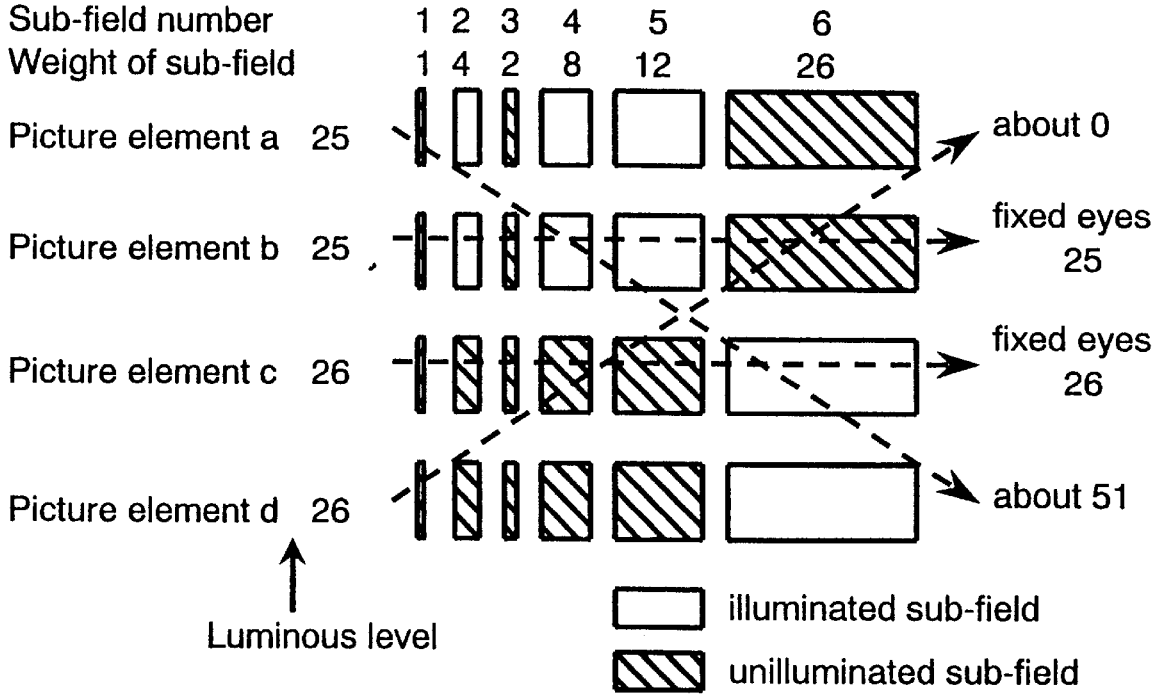

In case of a dynamic image, when eyes move a distance of three picture elements during a duration of the sub-field 1 and the sub-field 6 within one field, a luminous level to be caught in the case of FIG. 11A is approximately "20" (=4+16) because the eyes move on from an upper left to a lower right along an arrow from a picture element "a" to a picture element "d", and on the contrary, a luminous level of approximately "11" is caught by the eyes when they move from the picture element "d" to the picture element "a". In FIG. 11B, a luminous level to be caught is approximately "51" (=1+4+8+12+26) when the eyes move along an arrow from the picture element "a" to the picture element "d", and a luminous level is approximately "0" in a movement of eyes from the opposite picture element "d" to the picture element "a", between which the deviations from the proper luminous level are large.

When FIG. 11A and FIG. 11B are compared, it is obvious that the deviation shown in FIG. 11A of the luminous level, which is caught by the movement of eyes, is smaller so that a smallness of the secondary difference is considered effective based on this verification.

In short, it is understood that the deviation of the luminous level caught by the movement of eyes can be reduced in a range of low luminous level since variation of the primary differences is held relatively small, and the primary differences is given a tendency to increase as they come toward the end of the alignment in an ascending order, when the secondary differences are held at 3% of the total luminous gradations or less.

Third Exemplary Embodiment

A third exemplary embodiment of the present invention is now described. It is preferable for a deviation of perceivable luminous level from a proper luminous level to be smaller in sub-fields of smaller luminous level than sub-fields of higher luminous level. This can be characterized by using a mean value of the primary differences in the first half of all the sub-fields (this mean value is hereinafter called "AF") and a mean value of the primary differences in the latter half (this mean value is hereinafter called "AS") as parameters, in case of an arrangement in which the sub-fields are aligned in an ascending order of the weightings from the smallest one for a matter of convenience.

In case of adopting twelve pieces of sub-fields, for example, the AF is a mean value of the primary differences derived from the sub-fields 1 through 6, and the AS is a mean value of the primary differences derived from the sub-fields 7 through 12, as they are aligned in an ascending order of luminous level.

There is described here, that a deviation of luminous level becomes smaller, when characterized by the parameters of AF and AS, in a case that the primary difference is 6% of a total number of luminous gradations or less whereas the secondary difference is not 3% of a total number of gradations or less. Weightings of sub-fields for that case example are depicted in FIG. 12.

Figure 12:
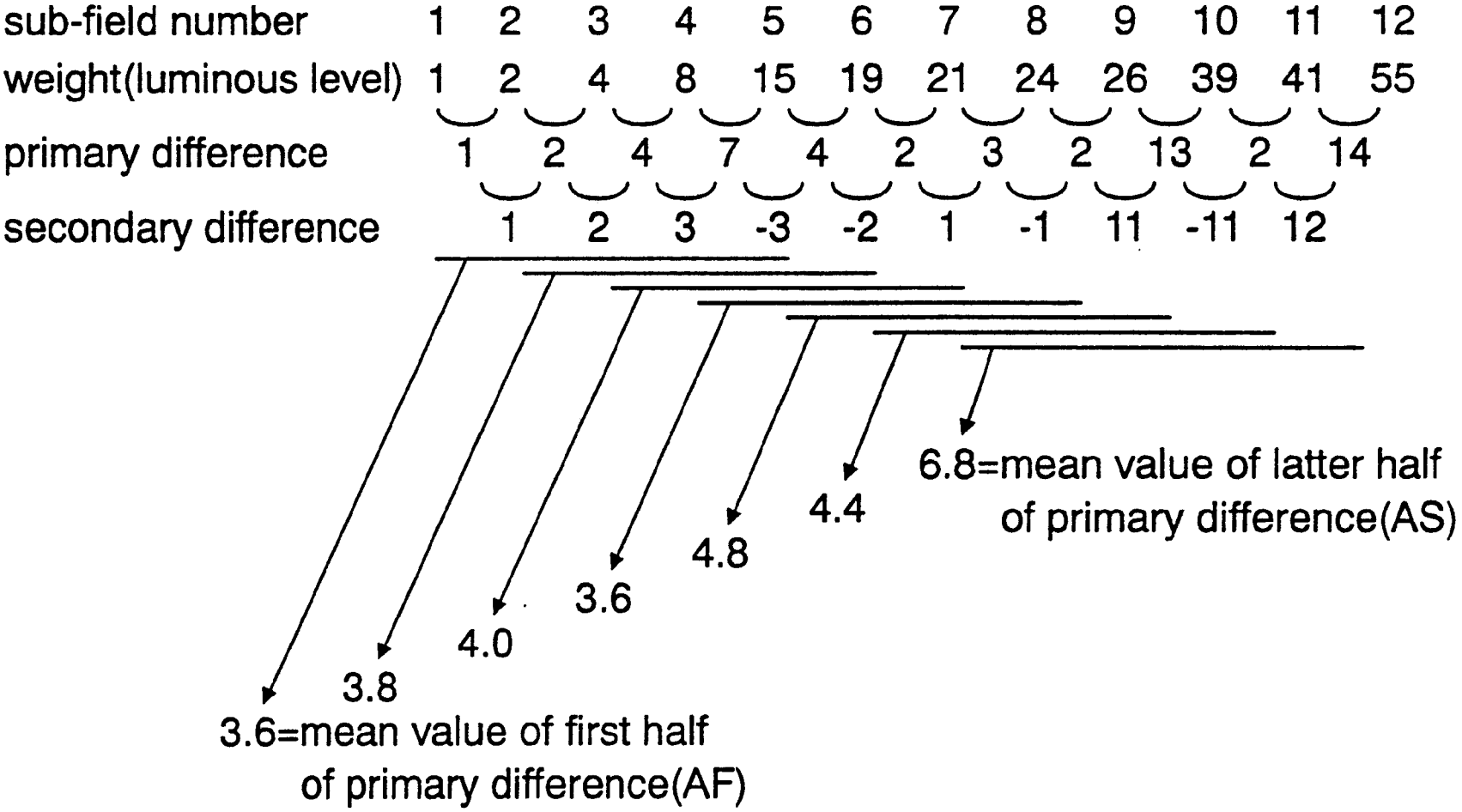
FIG. 12 is a diagram depicting weightings given on the basis of luminous level to sub-fields in accordance with a third exemplary embodiment of the present invention.

While a maximum value of the primary differences is "14" which is less than 6% of the total number of gradations in the example of FIG. 12, a maximum value of the secondary differences is "12" which is not 3% of the total number of gradations or less. Also, parameters, AF and AS are 3.6 and 6.8, so that the second half is larger than the first half.

Figure 13:
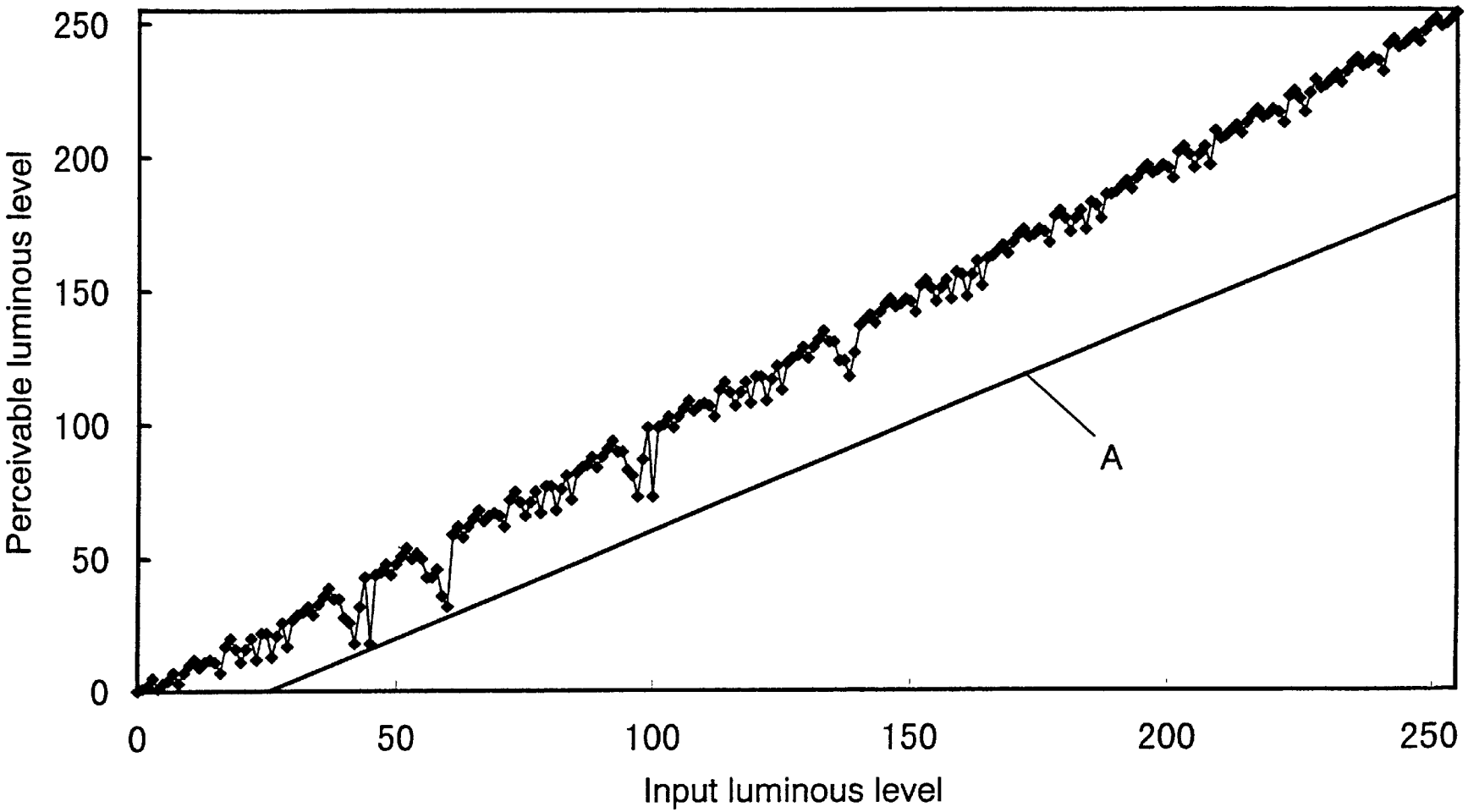
FIG. 13 is a graphic chart showing a relationship between the luminous level input and the perceivable luminous level when the weightings on the basis of luminous level are given to the sub-fields in accordance with FIG. 12.

FIG. 13 shows deviations of luminous level by an input of the ramp signal in case of the example of FIG. 12 (calculated based on an order of illuminating the sub-fields as being 1, 4, 2, 8, 15, 19, 21, 24, 26, 39, 41 and 55 as depicted by the weight of the sub-fields). When FIG. 13 is compared with FIG. 4 which shows deviations of luminous level corresponding to FIG. 2, it is obvious that the former has a smaller tendency of causing deviations of luminous level since the number of large peaks of the deviation of luminous level caused by the former is six whereas the latter is twelve, even though peak values of the deviations of luminous level are nearly equivalent in a part where the luminous level is 150 or below.

Moreover, when an idea of using mean value of the primary differences as parameter was expanded, not only for two parts, the first and the latter halves, of all the sub-fields, but also for shifted mean values between the two, it was known that the mean values, which increase successively and monotonously, are more effective against deviations of luminous level.

As an example, when each of the mean values derived from five each of the primary differences from an AF of the first half to an AS of the latter half based on the weightings depicted in FIG. 10 is examined, they increase monotonously in a sequence of 3.0, 3.6, 4.2, 4.8, 5.4, 6.0 and 6.8. On the contrary, when each of mean values derived from five each of the primary differences from the AF of the first half to the AS of the latter half in case of the weightings as shown in FIG. 12, is examined, they are 3.6, 3.8, 4.0, 3.6, 4.8, 4.4, and 6.8, in that order which is not a monotonous increase.

Figure 14:
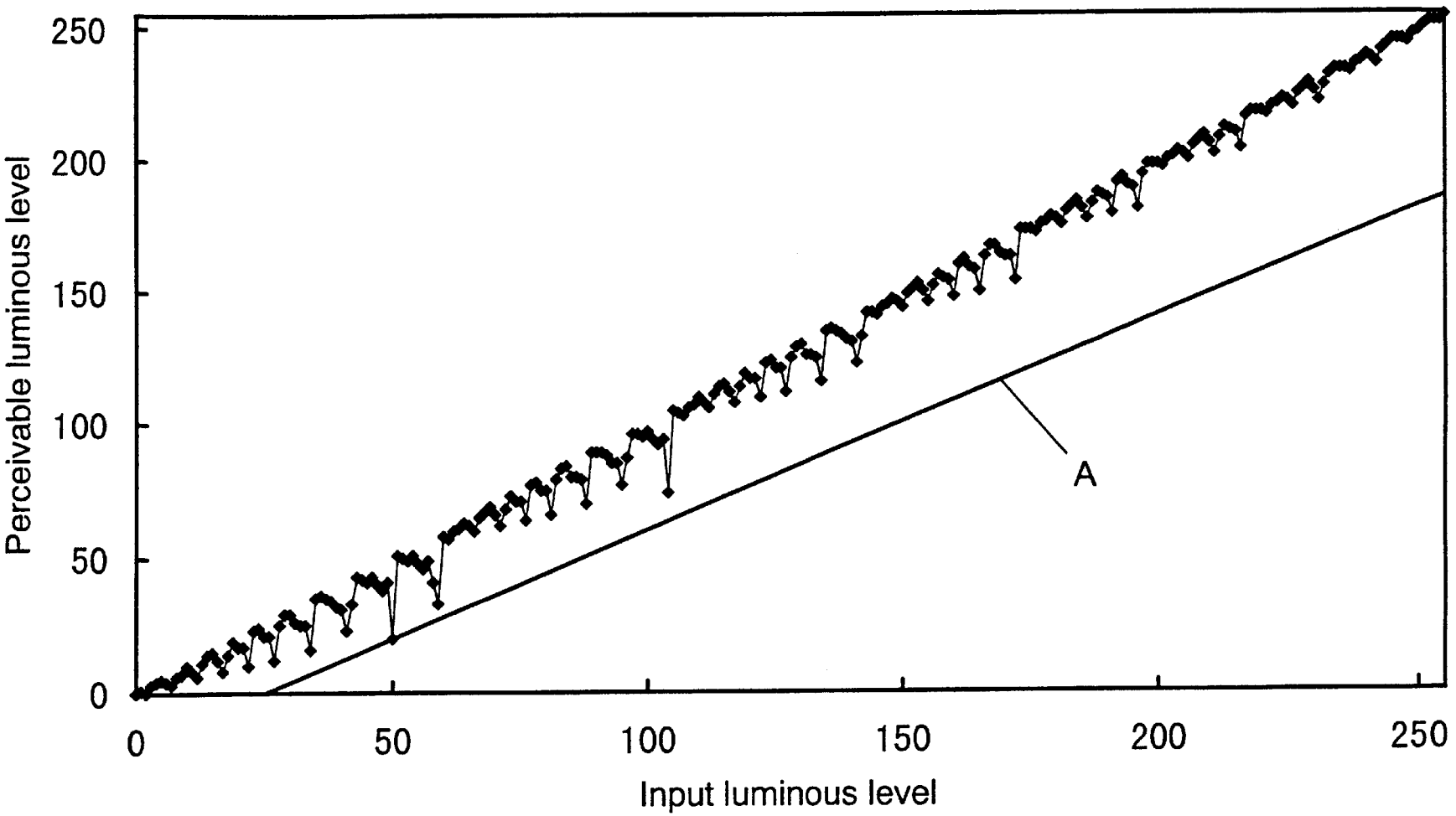
FIG. 14 is a graphic chart showing a relationship between the luminous level input and the perceivable luminous level when the weightings on the basis of luminous level are given to the sub-fields in accordance with FIG. 10 in the third exemplary embodiment of the present invention.

FIG. 14 shows the result of calculating deviations of luminous level caused on the inputted ramp signal by a composition of the sub-fields, which are assigned with weightings as depicted in FIG. 10. Similarly, FIG. 13 shows a result of calculating deviations of luminous level caused on the inputted ramp signal by a composition of the sub-fields, which are assigned with weightings as depicted in FIG. 12. Through a comparison of the FIG. 14 and FIG. 13 and a visual verification, it became clear that peaks of the deviation of luminous level are well spread instead of being centered with FIG. 14 than FIG. 13, so as to have an effect on the pseudo contours in dynamic images to become inconspicuous.

The effect of reducing the deviations of luminous level by using mean value of the primary differences as parameter has been described thus far, whereas it comes to a condition that each value of the primary differences themselves are to be monotonously increased when a more definitive condition for the effect is sought.

Shown in FIG. 15 is an example.

The example depicted in FIG. 15 comprises twelve sub-fields. A first line and a second line respectively indicate sub-field numbers and weightings assigned for the individual sub-fields. The sub-field is aligned in an ascending order of the weights for a matter of convenience. A third line indicates values of primary difference, and a forth line is for values of secondary difference.

The weights to be assigned for the individual sub-fields according to the sub-field numbers, are 1, 2, 4, 7, 11, 16, 21, 26, 32, 38, 45 and 52, and the primary differences are 1, 2, 3, 4, 5, 5, 5, 6, 6, 7 and 7, and that the secondary differences are 1, 1, 1, 1, 0, 0, 1, 0, 1 and 0. In this example, the primary differences are monotonously increased from the primary difference between the sub-fields of smallest weight toward the primary difference between the sub-fields of largest weight.

Figure 16:
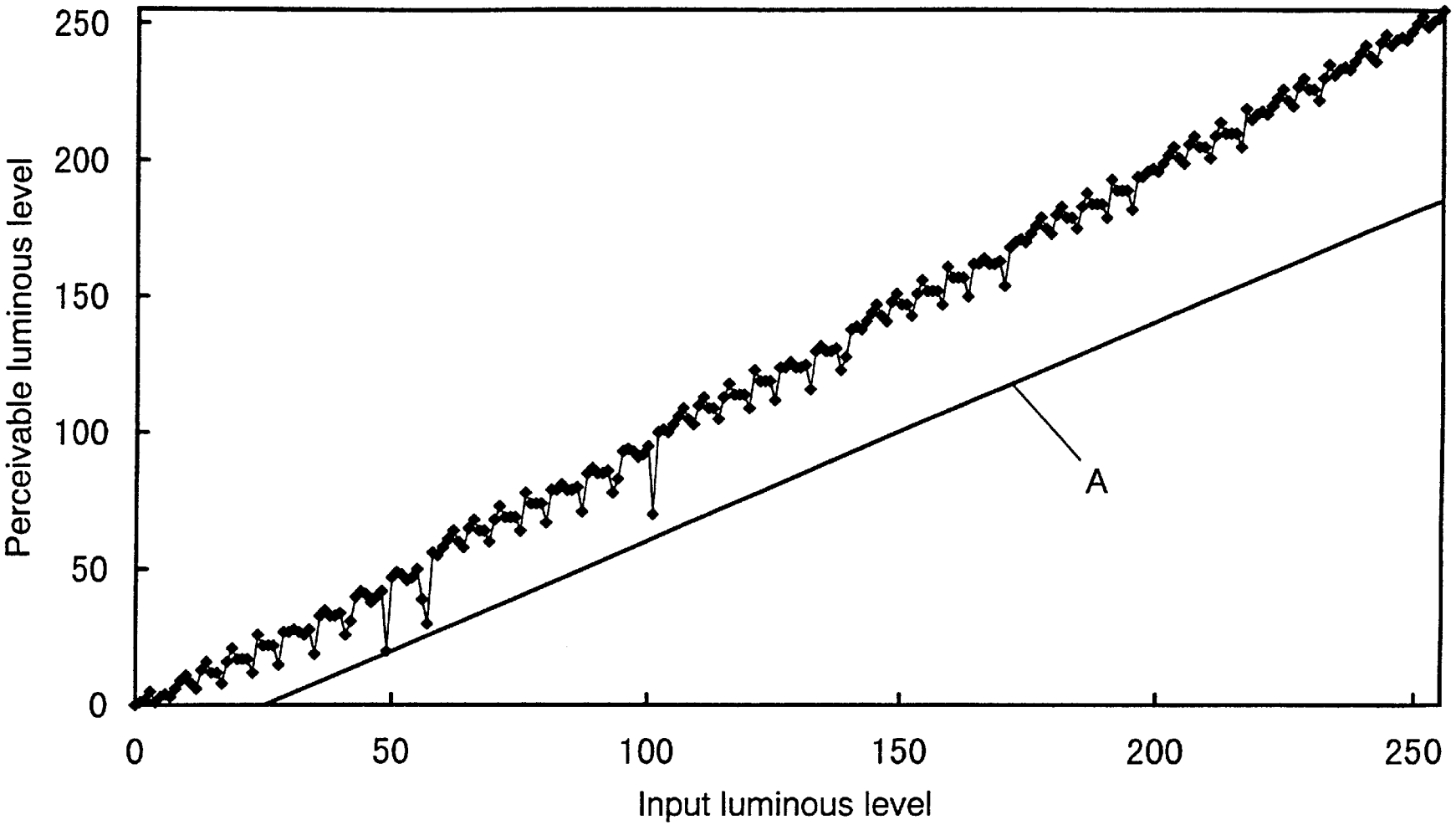
FIG. 16 is a graphic chart showing a relationship between the luminous level input and the perceivable luminous level when the weightings on the basis of luminous level are given to the sub-fields in accordance with FIG. 15.

With regard to this example, it is known, through an examination of FIG. 16, which calculates deviations of luminous level by using an input of the ramp signal (an order of illuminating the sub-fields is 1, 4, 2, 7, 11, 16, 21, 26, 32, 38, 45 and 52 as depicted by the weight of the sub-fields), that peaks of the deviation are spread instead of being concentrated, and that the peak values themselves are suppressed smaller in general as compared with FIG. 14. This fact is confirmed by a visual verification as well.

Fourth Exemplary Embodiment

A fourth exemplary embodiment of the present invention is now described. In the first through third embodiments, the examples are described with combinations that select sub-fields from those of larger weighting preferentially, while there are several ways of redundancy in combining the sub-fields of various weights for showing any level of luminous level. However, it was found that a selection and a combination preferentially of the sub-fields with smaller weightings are more desirable from the viewpoint of saturation characteristic of luminous level, for the reason described below.

Used as an example here is the weightings depicted in FIG. 10, i.e. the individual sub-fields, numbered from 1 through 12, are assigned with weights of 1, 2, 4, 7, 11, 16, 20, 25, 31, 38, 46 and 54 respectively (the sub-fields are aligned in an ascending order of the weights for a matter of convenience). FIG. 17 and FIG. 18 show two examples depicting selections and combinations of the sub-fields for illuminating luminous levels of "1" to "30".

In FIG. 17, the sub-fields of smaller weights are preferentially used for illuminating any level of luminous level, and in FIG. 18, the sub-fields of larger weights are preferentially used for illuminating any level of luminous level. The sub-fields that are marked with a circle are to be used for illumination.

When taking an example of showing a luminous level of "25", a selection scheme shown in FIG. 18, which preferentially uses the sub-fields of larger weights, illuminates only the sub-field 8, whereas another selection scheme shown in FIG. 17, which preferentially uses the sub-fields of smaller weight, illuminates five sub-fields, i.e., sub-field 1 (luminous level of "1"), sub-field 2 (luminous level of "2"), sub-field 3 (luminous level of "4"), sub-field 4 (luminous level of "7"), and sub-field 5 (luminous level of "11").

When the luminous level of these cases are compared, the latter is perceived brighter than the former. This occurs for the reason that luminous level to be observed of an illuminant generally saturates, when a frequency of illuminations is increased or duration of illumination is prolonged within a short period of time. In order to moderate the saturation of luminous level, countermeasures such as lowering an absolute luminous level, spreading illuminations in time wise fashion within an integration time of eyes and others are effective, although spreading the number of illuminations within the integration time of eyes is a preferable method since a high luminous level is desired for image display devices. This means that luminous level can be made closer to the proper luminous level by moderating the luminous saturation when illuminations are spread among a plurality of the sub-fields, as depicted in FIG. 17, to display the luminous level so as to avoid concentration in time wise fashion of the illuminations.

In order to illuminate not only a luminous level of "25" but also luminous levels of "1" through "30", an average number of the sub-fields to be selected and combined for each luminous gradation is 3.0 pieces/luminous level (=89 pieces/30 luminous levels) when the sub-fields of smaller weight are preferentially used, whereas an average number of the sub-fields when the sub-fields of larger weight are preferentially used is 1.9 pieces/luminous level (=58 pieces/30 luminous levels), which indicate that luminous level is illuminated across more sub-fields in case the sub-fields of smaller weight are preferentially used.

In other words, a luminous saturation of illuminants is moderated by spreading illuminations into more sub-fields when the sub-fields of smaller weight are preferentially used in illuminating any luminous level. As a result, it becomes possible to obtain a better half tones clarity and to improve a picture quality in both still images and dynamic images.

Figure 19:
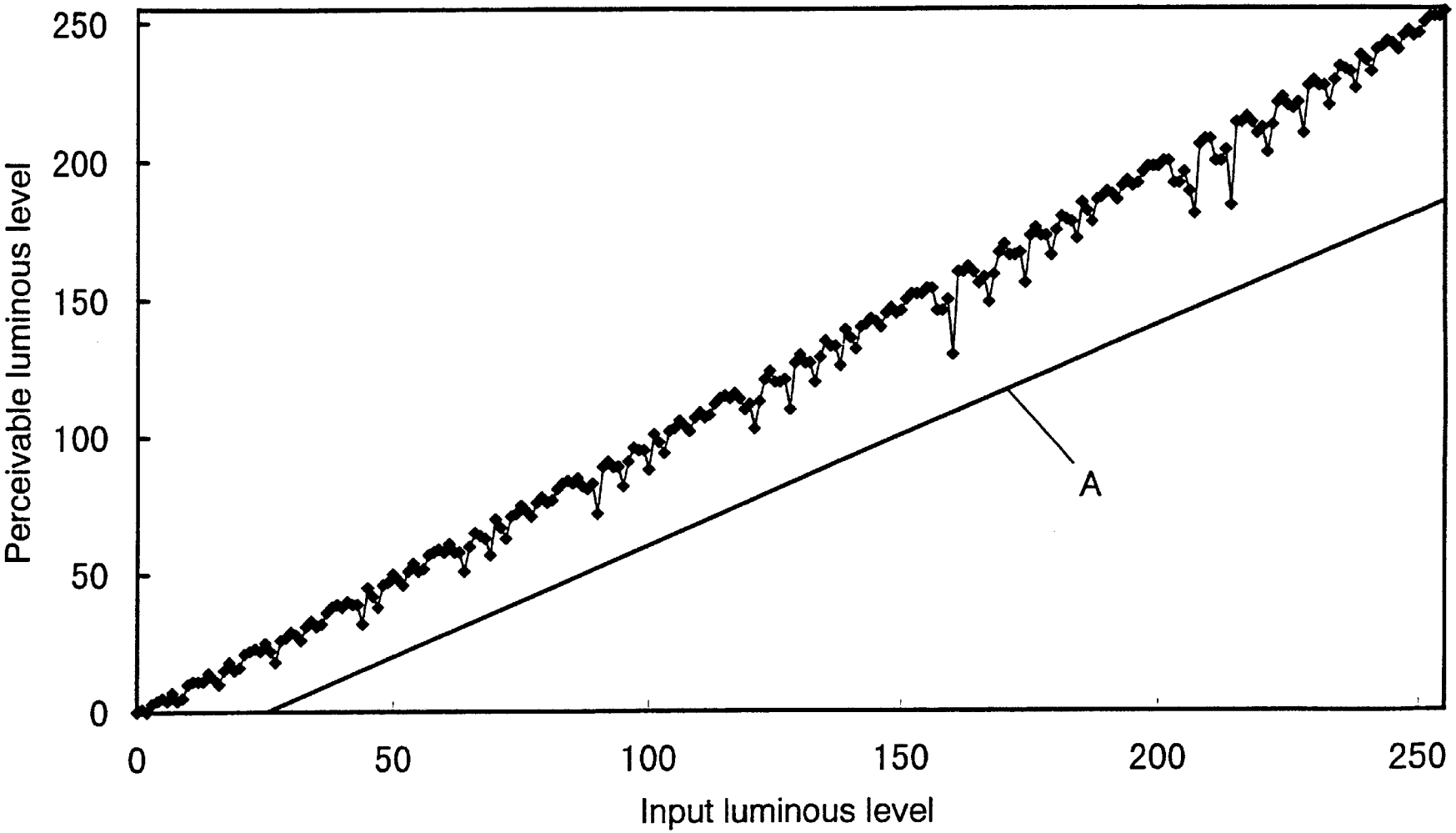
FIG. 19 is a graphic chart showing a relationship between the luminous level input and the perceivable luminous level, in accordance with FIG. 17.

Moreover, with regard to these two examples, when comparing FIG. 14 wherein the sub-fields of larger weight are preferentially used and FIG. 19 of the present embodiment, both of which figures calculate deviations of luminous level by using the ramp signal as an input and moving the signal at a predetermined speed, it becomes known that the peak value of the deviations of luminous level is substantially improved and that it is effective in respect of the pseudo contours in dynamic images at low luminous level zone, if the sub-fields of smaller weight are preferentially used. According to the calculation in FIG. 14 and FIG. 19, an order of illuminating the sub-fields is set for 1, 3, 2, 4, 5, 6, 7, 8, 9, 10, 11, 12 with reference to the sub-field numbers of FIG. 10, and it does not set a limit to the ascending order.

It is also noted that this effect is derived not only from the weightings of FIG. 10, but also from all the cases discussed in embodiments 1 through 3.

Fifth Exemplary Embodiment

A fifth exemplary embodiment of the present invention is now described. Among conditions that are generally said to be effective as ways to reduce pseudo contours in dynamic images, there is a condition that a time, at which any luminous level is illuminated, and another time, at which another luminous level close to the former luminous level is illuminated, shall be as close to each other as possible. Here, the embodiment of the present invention is described based on the condition by referring to an example of weightings assigned to individual sub-fields as shown in FIG. 10.

In the example, consideration is given to a case in which the sub-fields are activated while they are aligned in an ascending order of the weights, when the sub-fields are illuminated and then superposed to show luminous levels of "0" to "255" according to a priority of the sub-fields of smaller weight. In the previous embodiments, descriptions were made for an arrangement, in which the sub-fields are aligned in the order of the weights, whereas a description here differs in a point that it restricts an order of illumination itself to an ascending order.

A value called "mean position of luminous sub-field" is defined to quantitatively indicate a time at which any luminous level is illuminated, as follows:

$$\text{"Mean position of luminous sub-field"}=(1/A)\times(B/C),$$

where A: a number of sub-fields that constitute a field,

B: a sum of sub-field numbers that illuminate when showing any luminous level, and C: a number of sub-fields that illuminate when showing any luminous level.

Figure 20:
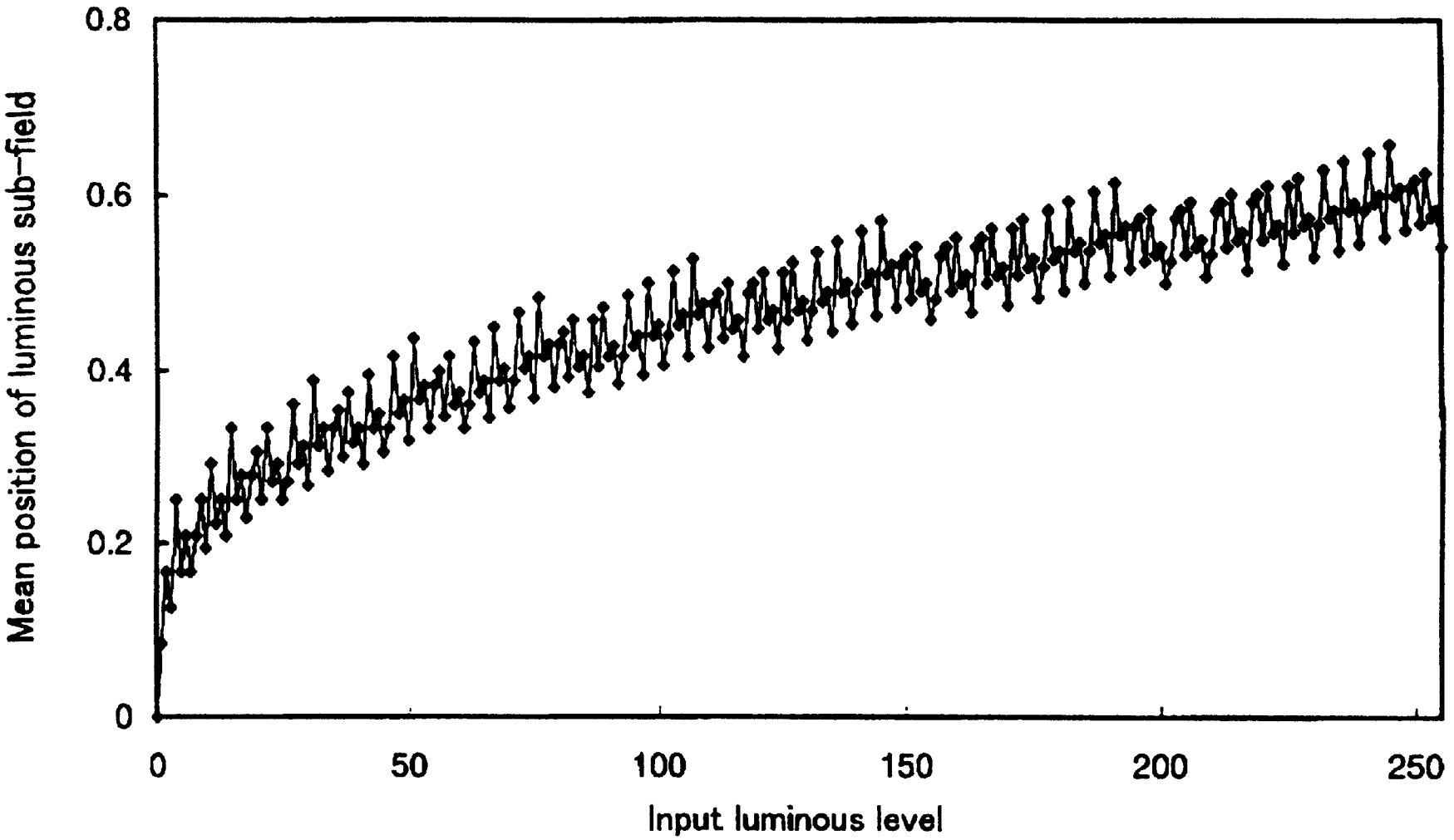
FIG. 20 is a first diagram depicting an average position of luminous sub-fields in accordance with a fifth exemplary embodiment of the present invention.

FIG. 20 shows "mean positions of luminous sub-field" corresponding to an input of the luminous level as calculated by the above formula. One point in the figure, a luminous level of "20", is described as an example. "A" in the formula is 12 because it is the number of sub-fields that constitute a field. In order to show the luminous level of "20", the sub-fields that are marked with a circle along a line corresponding to the luminous level of "20" in FIG. 17 are selectively illuminated because the sub-fields of smaller weight are preferentially illuminated. That is, sub-field 2 (luminous level of "2"), sub-field 4 (luminous level of "7") and sub-field 5 (luminous level of "11") are illuminated. Therefore, the "B" becomes 11 (=2+4+5), and "C" is 3, so that the "mean position of luminous sub-field" is calculated as $(1/12)\times(11/3)=0.305$. Accordingly it is apprehended that a mean position of the sub-fields is located in a point of approximately 30% of duration of one field from the start, when the sub-fields are illuminated to show the luminous level of "20".

In the present embodiment, an axis of ordinates in FIG. 20 may be considered as a position of time within one field when a time duration of field is introduced with a numeral "1" in the axis, since the sub-fields are illuminated in time wise fashion according to the sub-field number. FIG. 20 shows that the "mean position of luminous sub-field" increases smoothly along with the luminous level, which indicates a moment of illumination gradually shifts from a start time zone toward an end time zone within the time duration of one field, as the luminous level increases.

Figure 21:
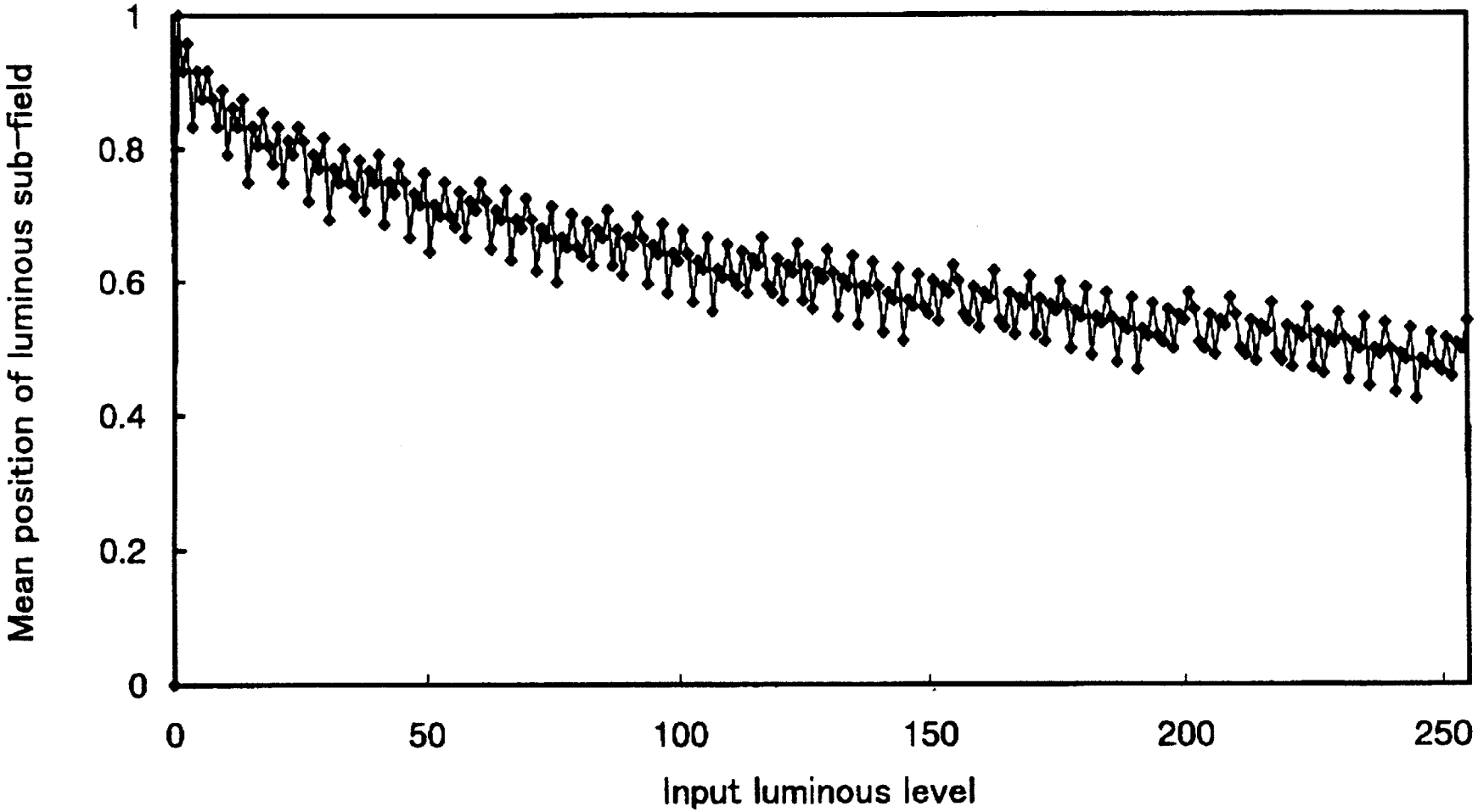
FIG. 21 is a second diagram depicting an average position of luminous sub-fields in accordance with the fifth exemplary embodiment of the present invention.

Also, when a sequence of illumination of the sub-fields is in a descending order as opposed to the ascending order, i.e., the sub-fields are illuminated in sequence from the sub-fields of larger weighting, the same effect as that of the ascending order is obtained. Mean positions of luminous sub-field corresponding to an input of the luminous level in this instance is shown in FIG. 21, wherein it is obvious that the mean position of luminous sub-field decreases smoothly along with the luminous level, which indicates a moment of illumination gradually shifts from an end time zone toward a start time zone within the time duration of one field, as the luminous level increases.

A consideration is given in a case where picture elements, which have illuminating time (i.e., a moment of illumination, at which picture elements having close levels of luminous level illuminate in sub-fields that exist in similar time zone within the duration of one field) driven by the present embodiment and whose luminous levels are close to each other, are spatially adjoining. Even if eyes that follow movement of a dynamic picture catch a luminous level of a plurality of the sub-fields across a plurality of the adjoining picture elements, a probability of causing a deviation of luminous level is small, and a confusion of gradations is unlikely to occur, because the picture elements are given with illuminating time at which to illuminate in the sub-fields that exist in a similar time zone within one field.

Figure 22:
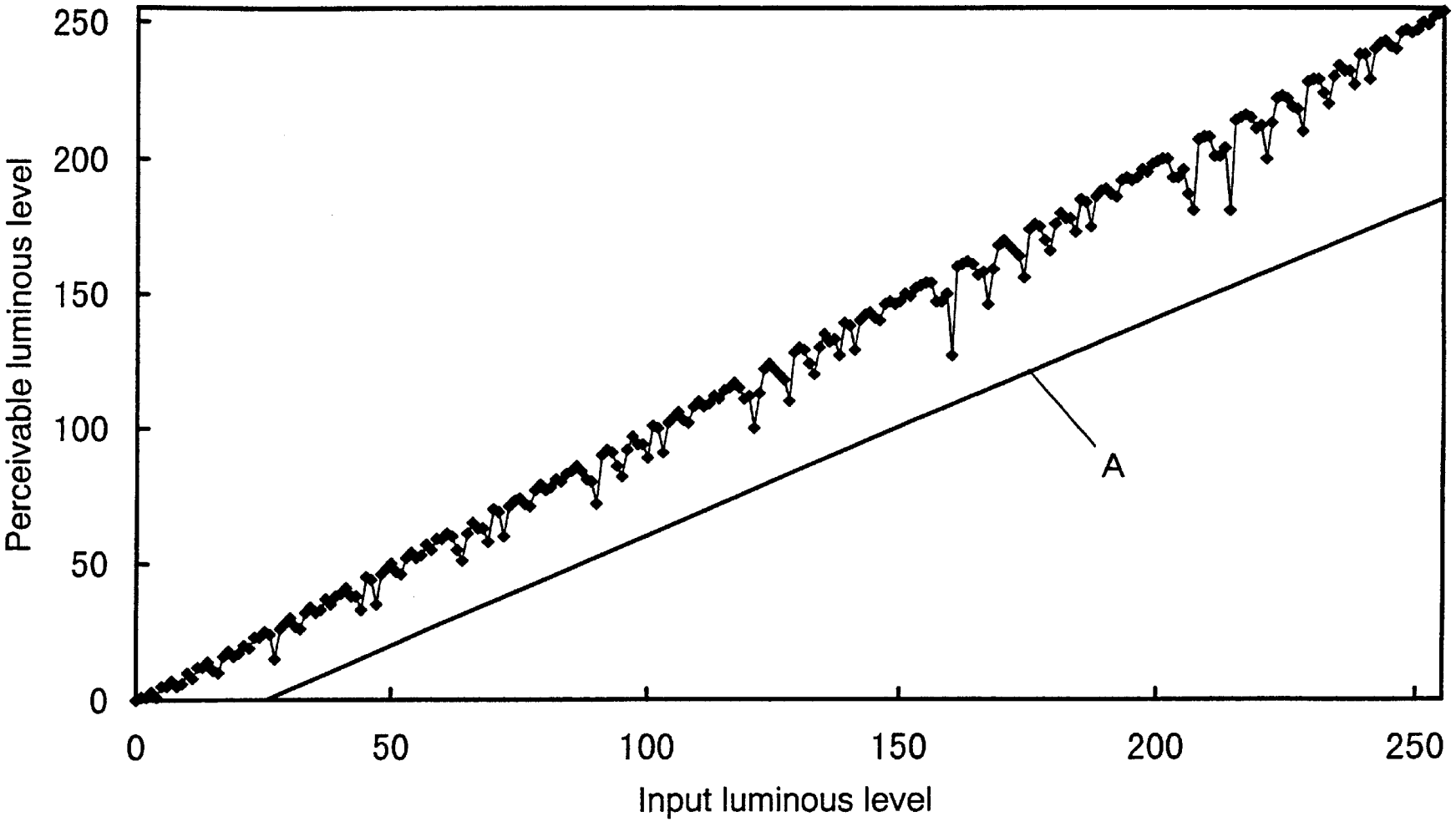
FIG. 22 is a graphic chart showing a relationship between the luminous level input and the perceivable luminous level, in accordance with FIG. 20.
Figure 23:
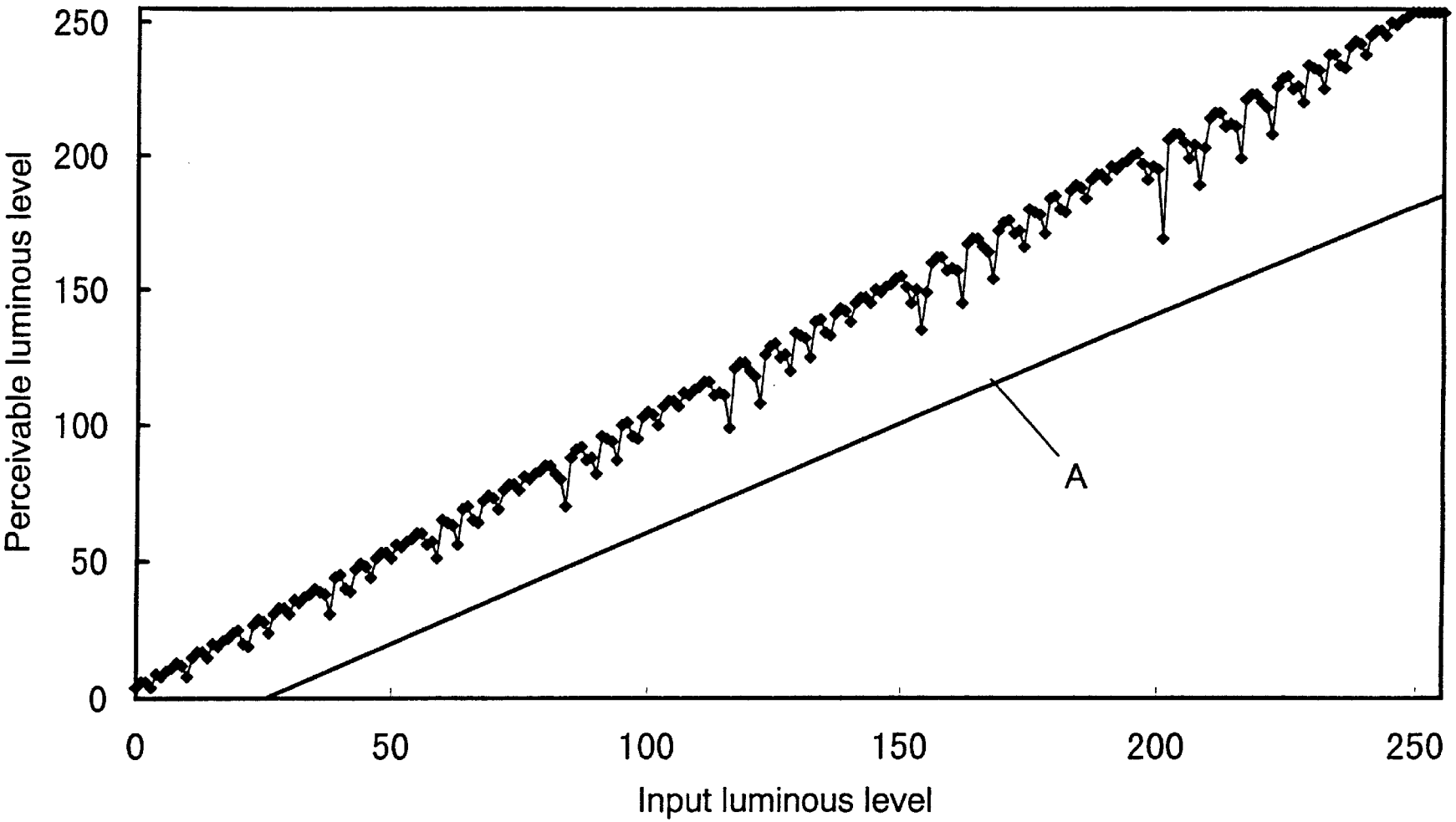
FIG. 23 is a graphic chart showing a relationship between the luminous level input and the perceivable luminous level, in accordance with FIG. 21.

Perceivable luminous levels calculated in relation to an inputted ramp signal are shown in FIG. 22 in case of the ascending order and in FIG. 23 in case of the descending order.

If the sub-fields of smaller weight are preferentially selected and combined in addition to arranging the sequence of illumination either in an ascending order or in a descending order in showing any luminous level, deviations of the luminous level are reduced, and a confusion of gradations, i.e., pseudo contours in dynamic images is unlikely to occur when eyes follow a moving image. This fact applies not only to an example of the weightings in FIG. 10, but also to all of the previous examples of weightings.

Even though the above descriptions refer to only examples, in which the number of sub-fields is twelve pieces, the number of sub-fields are not necessarily restricted to twelve, since the same effect is obtainable with any number so long as it conforms with means to solve a problem that the present invention addresses.

For an example where there are eleven sub-fields, weightings may be arranged in proportion of either 1, 2, 4, 8, 13, 19, 26, 34, 42, 49 and 57 as in FIG. 25, or 1, 2, 4, 8, 14, 20, 26, 33, 41, 49 and 57 as in FIG. 26, and if for another example where there are ten sub-fields, weighting may be arranged in proportion of either 1, 2, 4, 8, 16, 25, 34, 44, 55, and 66 as in FIG. 27 or 1, 2, 4, 8, 15, 24, 33, 44, 56, and 68 as in FIG. 28. The same effect, that a deviation of the luminous level, i.e. pseudo contours in dynamic images, is unlikely to occur when eyes follow a moving image, is obtainable in both examples.

With the method for displaying luminous half tones of the present invention, an appearance of the pseudo contours in dynamic image is substantially reduced and a picture quality for dynamic images is improved as compared to the prior art.

With the method for displaying luminous half tones of the present invention, an appearance of the pseudo contours in dynamic image is reduced and a picture quality for dynamic images is improved especially in low luminous level zone.

With the method for displaying luminous half tones of the present invention, an appearance of the pseudo contours in dynamic image is totally reduced from low luminous level zone to high luminous level zone.

With the method for displaying luminous half tones of the present invention, better half tones gradational clarity is obtained and picture quality is improved without regard to still images and dynamic images, and furthermore, appearance of the pseudo contours in dynamic image is reduced substantially and picture quality for dynamic images is improved especially in low luminous level zone.

Also, with the method for displaying luminous half tones of the present invention, an appearance of the pseudo contours in dynamic image is further reduced remarkably and a picture quality for dynamic images is improved from low luminous level zone to high luminous level zone.

While the present embodiments above are described in a case of the total luminous gradations of 256, it is a matter of course that the number of luminous gradations is not restricted to only 256. Also, modifications and changes can be made to the present invention. Therefore, it is to be understood that all modifications and changes that fall within the true spirit and scope of the present invention are covered by the appended claims.

What is claimed is:

1. A method of displaying luminous gradations comprising the steps of:

assigning each of a plurality of binary images with a respective weight which corresponds to each image's respective luminous level; and displaying in time wise fashion said plurality of binary images;

wherein each weight is assigned so that, when said plurality of binary images are rearranged by weight in ascending order, (1) an absolute value of the difference in weight ("primary difference") between any sequential two of said plurality of binary images is less than or equal to 6%, of a total number of luminous gradations that can be displayed in time wise fashion by superposing said plurality of binary images, and (2) a mean value of an absolute value of said primary differences between said plurality of binary images, which are positioned in a first half among all of said plurality of binary images is smaller than a mean value of an absolute value of said primary differences between said plurality of binary images, which are positioned in a latter half among all of said plurality of binary images.

2. The method for displaying luminous gradations according to claim 1, wherein each weight is assigned so that, when said plurality of binary images are rearranged by weight in ascending order, an absolute value of the difference in said primary difference ("secondary difference") between any sequential two of an absolute value of said primary differences is less than or equal to 3% of said total number of luminous gradations.

3. The method for displaying luminous gradations according to claim 1, wherein said plurality of binary images are individually assigned with respective weights so that a mean value of said primary differences between binary images, which are positioned in a first half among all of said binary images is smaller than a mean value of said primary differences between binary images, which are positioned in a latter half.

4. The method for displaying luminous gradations according to claim 2, wherein said plurality of binary images are individually assigned with respective weights so that a mean value of said primary differences between binary images, which are positioned in a first half among all of said binary images is smaller than a mean value of said primary differences between binary images, which are positioned in a latter half.

5. The method for displaying luminous gradations according to claim 1, wherein said plurality of binary images are individually assigned with each respective weight so that, when a range of the primary differences, from which the mean value is obtained, is shifted one at a time from a group of the first half toward the latter half of the arrangement, each of the mean values increases monotonously.

6. The method for displaying luminous gradations according to claim 2, wherein said plurality of binary images are individually assigned with each respective weight so that, when a range of the primary differences, from which the mean value is obtained, is shifted one at a time from a group of the first half toward the latter half of the arrangement, each mean value is increased monotonously.

7. The method for displaying luminous gradations according to claim 1, wherein a combination of said plurality of binary images for showing any half tones is made of binary images selected from the smallest weight among said plurality of binary images.

8. The method for displaying luminous gradations according to claim 2, wherein a combination of said plurality of binary images for showing any half tones is made of binary images of smallest weight from among said plurality of binary images.

9. The method for displaying luminous gradations according to claim 5, wherein a combination of said plurality of binary images for showing any half tones is made of binary images of smallest weight from among said plurality of binary images.

10. The method for displaying luminous gradations according to claim 6, wherein a combination of said plurality of binary images for showing any half tones is made of binary images of smallest weight from among said plurality of binary images.

11. The method for displaying luminous gradations according to claim 7, wherein a time sequence of displaying said plurality of binary images is in an ascending order of weight of said plurality of binary images.

12. The method for displaying luminous gradations according to claim 8, wherein a time sequence of displaying said plurality of binary images is in an ascending order of said weight of said plurality of binary images.

13. The method for displaying luminous gradations according to claim 9, wherein a time sequence of displaying said plurality of binary images is in an ascending order of weight of said plurality of binary images.

14. The method for displaying luminous gradations according to claim 10, wherein a time sequence of displaying said plurality of binary images is in an ascending order of weight of said plurality of binary images.

15. The method for displaying luminous gradations according to claim 7, wherein a time sequence of displaying said plurality of binary images is in a descending order of weight of said plurality of binary images.

16. The method for displaying luminous gradations according to claim 8, wherein a time sequence of displaying said plurality of binary images is in a descending order of weight of said plurality of binary images.

17. The method for displaying luminous gradations according to claim 9, wherein a time sequence of displaying said plurality of binary images is in a descending order of weight of said plurality of binary images.

18. The method for displaying luminous gradations according to claim 10, wherein a time sequence of displaying said plurality of binary images is in a descending order of weight of said plurality of binary images.

19. A method of displaying luminous gradations comprising the steps of:

assigning each of a plurality of binary images with a respective weight which corresponds to each image's respective luminous level; and displaying in time wise fashion said plurality of binary images, wherein each weight is assigned so that, when said plurality of binary images are rearranged by weight in ascending order, (1) an absolute value of the difference in weight ("primary difference") between any sequential two of said plurality of binary images is less than or equal to 6% of a total number of luminous gradations that can be displayed in time wise fashion by superposing said plurality of binary images, (2) said primary difference increases monotonously from a side of said binary image of smallest weight toward a side of largest weight.

20. The method for displaying luminous gradations according to claim 19, wherein a combination of said plurality of binary images for showing any half tones is made of binary images of smallest weight from among said plurality of binary images.

21. The method for displaying luminous gradations according to claim 20, wherein a time sequence of displaying said plurality of binary images is in an ascending order of weight of said plurality of binary images.

22. The method for displaying luminous gradations according to claim 20, wherein a time sequence of displaying said plurality of binary images is in a descending order of weight of said plurality of binary images.

23. A method of displaying luminous gradations comprising the steps of:

assigning each of a plurality of binary images with a respective weight which corresponds to each image's respective luminous level; and displaying in time wise fashion, based on each weight, said plurality of binary images, wherein each weight is assigned so that, when said plurality of binary images are rearranged by said weight in ascending order, (1) an absolute value of the difference in weight ("primary difference") between any sequential two of said plurality of binary images is less than or equal to 6% of a total number of luminous gradations that can be displayed in time wise fashion by superposing said plurality of binary images, (2) all of an absolute value of the difference in said primary difference ("secondary difference") between any sequential two of an absolute value of said primary differences is less than or equal to 3% of said total number of luminous gradations, (3) said primary difference increases monotonously from a side of said binary image of smallest weight toward a side of largest weight.

24. The method for displaying luminous gradations according to claim 23, wherein a combination of said plurality of binary images for showing any half tones is made of binary images of smallest weight from among said plurality of binary images.

25. The method for displaying luminous gradations according to claim 24, wherein a time sequence of displaying said plurality of binary images is in an ascending order of weight of said plurality of binary images.

26. The method for displaying luminous gradations according to claim 24, wherein a time sequence of displaying said plurality of binary images is in a descending order of weight of said plurality of binary images.

27. A method of displaying luminous gradations comprising the steps of:

assigning each of a plurality of binary images with a respective weight which corresponds to each image's respective luminous level; and displaying in time wise fashion said plurality of binary images, wherein each weight is assigned so that, when said plurality of binary images are rearranged by weight in ascending order, (1) an absolute value of the difference in weight ("primary difference") between any sequential two of said plurality of binary images is less than or equal to 6% of a total number of luminous gradations that can be displayed in time wise fashion by superposing said plurality of binary images,(2) a combination of said plurality of binary images for showing any half tones is made of binary images preferentially selected from smallest weight among said plurality of binary images.

28. The method for displaying luminous gradations according to claim 27, wherein a time sequence of displaying said plurality of binary images is in an ascending order of weight of said plurality of binary images.

29. The method for displaying luminous gradations according to claim 27, wherein a time sequence of displaying said plurality of binary images is in a descending order of weight of said plurality of binary images.

30. A method of displaying luminous gradations comprising the steps of:

assigning each of a plurality of binary images with a respective weight which corresponds to each image's respective luminous level; and displaying in time wise fashion said plurality of binary images, wherein each weight is assigned so that, when said plurality of binary images are rearranged by weight in ascending order, (1) an absolute value of the difference in weight ("primary difference") between any sequential two of said plurality of binary images is less than or equal to 6% of a total number of luminous gradations that can be displayed in time wise fashion by superposing said plurality of binary images, (2) all of an absolute value of the difference in said primary difference ("secondary difference") between any sequential two of an absolute value of said primary differences is less than or equal to 3% of said total number of luminous gradations, (3) a combination of said plurality of binary images for showing any half tones is made of binary images preferentially selected from smallest weight among said plurality of binary images.

31. The method for displaying luminous gradations according to claim 30, wherein a time sequence of displaying said plurality of binary images is in an ascending order of weight of said plurality of binary images.

32. The method for displaying luminous gradations according to claim 30, wherein a time sequence of displaying said plurality of binary images is in a descending order of weight of said plurality of binary images.

33. A method for displaying luminous gradations comprising the steps of:

assigning twelve portions of binary images with respective weights corresponding to luminous levels in a proportion of 1, 2, 4, 6, 10, 14, 19, 26, 33, 40, 47 and 53, displaying in time wise fashion said twelve portions of binary images, wherein (1) a combination of said twelve portions of binary images for showing any half tones is made of binary images preferentially selected from smallest weight among said twelve portions of binary images, and (2) a time sequence of displaying said binary images is in an ascending order or in a descending order of weight of said binary images.

34. A method for displaying luminous gradations comprising the steps of:

assigning twelve portions of binary images with respective weights corresponding to luminous levels in a proportion of 1, 2, 4, 7, 11, 16, 21, 26, 32, 38, 45 and 52, displaying in time wise fashion said twelve portions of binary images, wherein (1) a combination of said twelve portions of binary images for showing any half tones is made of binary images preferentially selected from smallest weight among said twelve portions of binary images, and (2) a time sequence of displaying said binary images is in an ascending order or in a descending order of weight of said binary images.

35. A method for displaying luminous gradations comprising the steps of:

assigning eleven portions of binary images with respective weights corresponding to luminous levels in a proportion of 1, 2, 4, 8, 13, 19, 26, 34, 42, 49 and 57, displaying in time wise fashion said eleven portions of binary images, wherein (1) a combination of said eleven portions of binary images for showing any half tones is made of binary images preferentially selected from smallest weight among said eleven portions of binary images, and (2) a time sequence of displaying said binary images is in an ascending order or in a descending order of weight of said binary images.

36. A method for displaying luminous gradations comprising the steps of:

assigning eleven portions of binary images with respective weights corresponding to luminous levels in a proportion of 1, 2, 4, 8, 14, 20, 26, 33, 41, 49 and 57, displaying in time wise fashion said eleven portions of binary images, wherein (1) a combination of said eleven portions of binary images for showing any half tones is made of binary images preferentially selected from smallest weight among said eleven portions of binary images, and (2) a time sequence of displaying said binary images is in an ascending order or in a descending order of weight of said binary images.

37. A method for displaying luminous gradations comprising the steps of:

assigning ten portions of binary images with respective weights corresponding to luminous levels in a proportion of 1, 2, 4, 8, 16, 25, 34, 44, 55 and 66, displaying in time wise fashion said ten portions of binary images, wherein (1) a combination of said ten portions of binary images for showing any half tones is made of binary images preferentially selected from smallest weight among said ten portions of binary images, and (2) a time sequence of displaying said binary images is in an ascending order or in a descending order of weight of said binary images.

38. A method for displaying luminous gradations comprising the steps of:

assigning ten portions of binary images with respective weights corresponding to luminous levels in a proportion of 1, 2, 4, 8, 15, 24, 33, 44, 56 and 68, displaying in time wise fashion said ten portions of binary images, wherein (1) a combination of said ten portions of binary images for showing any half tones is made of binary images preferentially selected from smallest weight among said ten portions of binary images, and (2) a time sequence of displaying said binary images is in an ascending order or in a descending order of weight of said binary images.

* * * * *